United States Patent [19]

Tachika et al.

[11] 4,275,958

[45] Jun. 30, 1981

[54] COPYING APPARATUS

[75] Inventors: Tetsuji Tachika, Tokyo; Hisashi Sakamaki, Yokohama; Hiroyuki Hattori, Tokyo, all of Japan

[73] Assignee: Canon Kabushiki Kaisha, Tokyo, Japan

[21] Appl. No.: 797,846

[22] Filed: May 17, 1977

[30] Foreign Application Priority Data

May 21, 1976 [JP] Japan ..... 51-56705

[51] Int. Cl.[3] ..... G03G 15/00

[52] U.S. Cl. ..... 355/14 R; 355/4

[58] Field of Search ..... 355/3 R, 4, 14, 16, 355/24

[56] References Cited

U.S. PATENT DOCUMENTS

| | | | |
|---|---|---|---|
| 3,597,076 | 8/1971 | Hubbard et al. | 355/3 R X |
| 3,848,995 | 11/1974 | Gauronski | 355/14 X |
| 3,909,128 | 9/1975 | Sohm | 355/14 X |
| 3,960,445 | 6/1976 | Drawe | 355/4 |
| 4,018,523 | 4/1977 | Hughes | 355/14 R X |
| 4,054,380 | 10/1977 | Donohue et al. | 355/3 R X |
| 4,165,165 | 8/1979 | Iwami et al. | 355/4 |

*Primary Examiner*—Fred L. Braun

*Attorney, Agent, or Firm*—Fitzpatrick, Cella, Harper & Scinto

[57] ABSTRACT

A copying apparatus has an input unit for entering plural copy mode data into the copying apparatus, memory for storing the data, and a control circuit for reading out copy mode signals in succession according to the data stored in the memory, upon completion of copying on a predetermined number of copying sheets, and for performing the copying operation in accordance with the copy mode signals.

20 Claims, 30 Drawing Figures

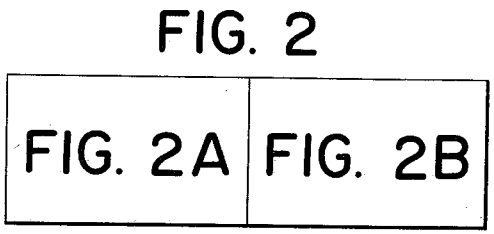
FIG. 2
FIG. 2A
FIG. 2B
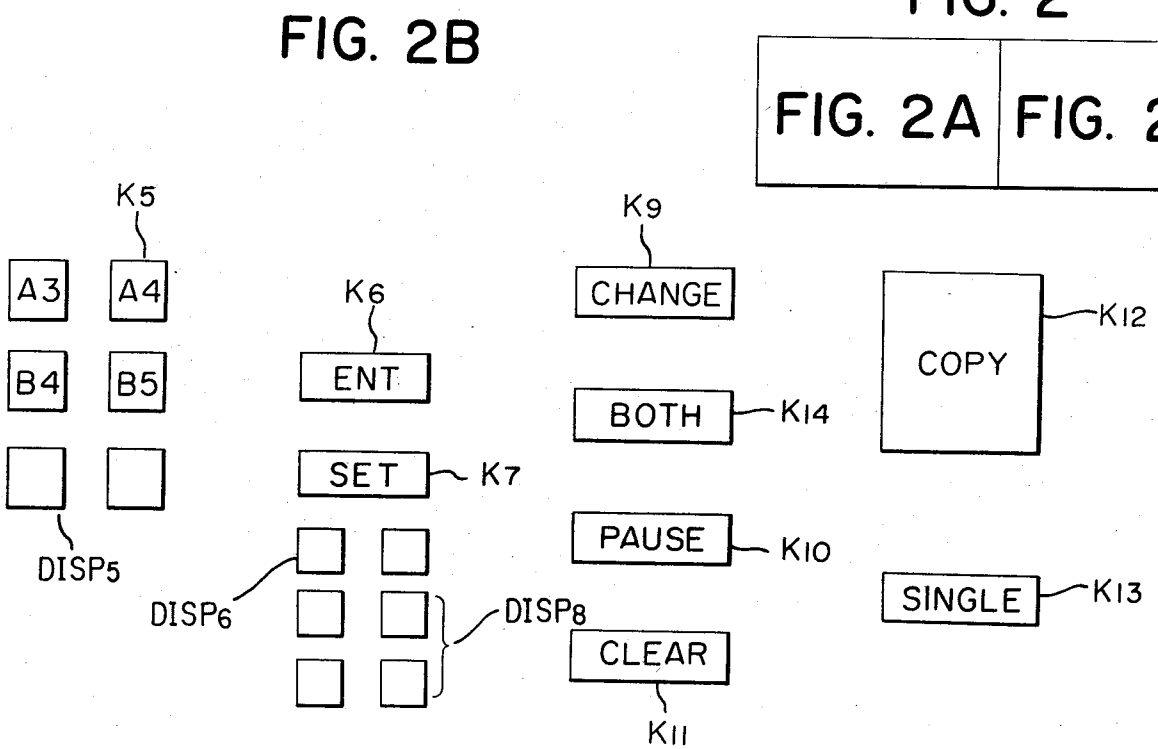
FIG. 2B
K5
A3
A4
B4
B5
DISP5
K6
ENT
K7
SET
DISP6
DISP8
K9
CHANGE
K10
PAUSE
K11
CLEAR
K12
COPY
K13
SINGLE
K14
BOTH

K1

B-Y
B-M
B-C
B-BK
RED & BK
FULL
ENC 1
STOP
RGS 1
RGS 2
RGS 3
MPx1
MPx2
17~21
DEC 3
MPx13
DEC 4
MPx14
DEC 5
MPx15
MPx10
MPx11
RGS 11
MPx12
RGS12
RGS13
GATE 1
DRV 3
DISP 1

K2
0
1
2
8
9
ENC 2
RGS 4
RGS 5
MP x 3
MP x 8
DEC 1
DRV 1
DISP
MP x 4
MP x 9
DEC 2
DRV 2
2
RGS 8
RGS 9
RGS10
DEC 6
DEC 7
DEC 8
GATE 2
DRV 4
COMP 2
COMP 1
GATE 3
PAPER FEED SIGNAL
CTU SIGNAL

K5
K9
K14
K7
A3
A4
B4
B5
CHANGE
BOTH
SET
ENC 3
ENC 4
ENC 5
RGS 6
RGS 7
RGS 23
MP x 5
MP x 6
MP x 23
RGS 22
RAM
RGS 19
MPx19
DEC 14
RGS 18
DRV 10
MPx20
DEC 15
DRV 11
MP x 21
RGS 20
RGS 21
DEC 16
DRV 12
DISP 6
RGS 1~7.23
CLEAR
K11
K13
SIGNAL
K10
PAUSE
CHANGE, BOTH

K1
K2
ENC1
ENC2
RGS1
RGS2
RGS3
RGS4
RGS5
MPX27
MPX28
MPX1
MPX2
MPX3
MPX4
MPX5
MPX8
RGS14
MPX13
G30
G31
RGS 26 OUT
FF 3
T4
Y SCAN
X SCAN
DISPLAY 7
DRV 13
DRV 14
DEC17
DEC18
MPX26
MPX25
MPX28
MPX27
G 31
G30
RGS4
RGS5
FF2
FF1
SET
KEY5
ENC 5
RGS23
MPX23
RGS22

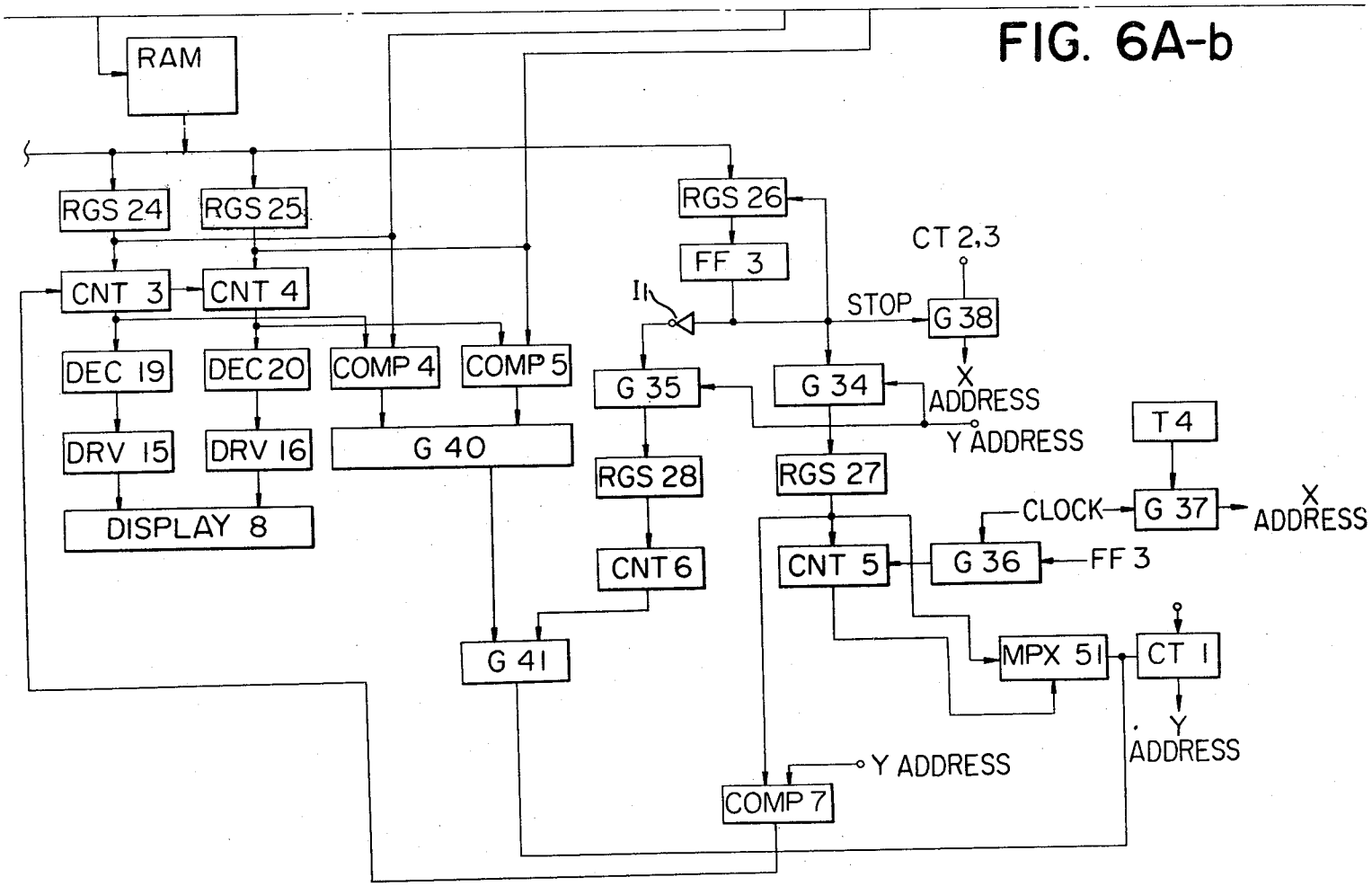
FIG. 6A-b

| FIG. 9A | FIG. 9B |
|---|---|

FIG. 13A-b

| FIG. 13A-a |
| --- |
| FIG. 13A-b |

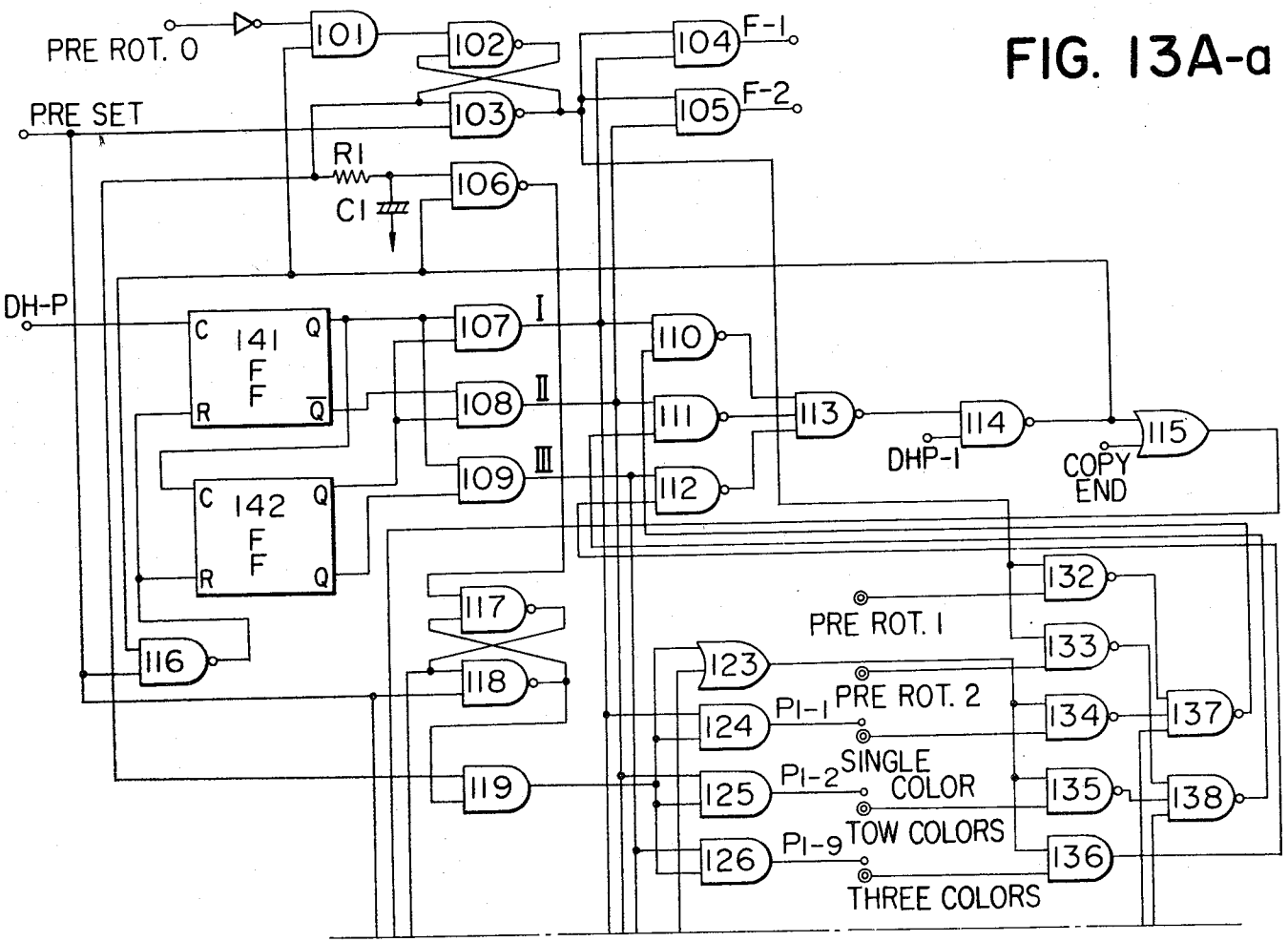
FIG. 13A-a

COPYING APPARATUS

BACKGROUND OF THE INVENTION a. Field of the Invention

The present invention relates to a copying apparatus with a programming capability.

b. Description of the Prior Art

Conventional copiers are generally provided only with limited functions of the preparation of copies of a number each time predetermined for each original or the selection of monochromatic or three-color copying mode in response to each presetting of color mode, and are therefore inconvenient, in case of copying in different sizes, copying in different color modes or copying in different copy numbers for different sizes or different color modes from a same original or in case of copying with different sizes, color modes or copy numbers from different originals, in requiring the operator to readjust the copying mode for each copying.

SUMMARY AND OBJECTS OF THE INVENTION

An object of the present invention is to prevent such drawbacks and to provide a copying apparatus capable of automatically making copies in different copying modes in succession from the same original.

Another object of the present invention is to provide a copying apparatus capable of automatically producing copies in different copying modes as mentioned above in succession from different originals.

Still another object of the present invention is to provide a copying apparatus capable of producing plural copies in the same copying mode from the same original, and producing copies in a different copying mode from an automatically exchanged different original.

Still another object of the present invention is to provide a copying apparatus capable of automatically producing copies in different copying modes in succession from the same original or different originals, and which is capable of repeating a plurality of times the copying in the same combination of said copying modes.

Yet another object of the present invention is to provide a copying apparatus capable of indicating the copying mode currently under execution and the succeeding copying mode.

Still another object of the present invention is to provide a color copying apparatus capable of producing copies of different combinations of color modes from the same original or different originals.

A further object of the present invention is to provide a two-side copying apparatus capable of producing copies on both sides of a paper sheet from the same original or different originals.

Yet another object of the present invention is to provide a copying apparatus capable of automatically producing copies in different copying modes in succession from the same original, then conducting copying in the same combination of copying modes from an automatically exchanged original and sorting the thus obtained copies according to said copying modes.

BRIEF DESCRIPTION OF THE DRAWINGS

FIG. 2 illustrates the relative positions of FIGS. 2A and 2B;

FIGS. 2A and 2B together provide an illustration of the control panel of the copying apparatus embodying the present invention;

FIGS. 13A-*a* and 13A-*b* and 14 are examples of color process mode determining circuit;

FIG. 13B is a time chart for explaining the function of the process mode determining circuit shown in FIGS. 13A-*a* and -*b;*

DESCRIPTION OF THE PREFERRED EMBODIMENTS

Figures 1, 8:
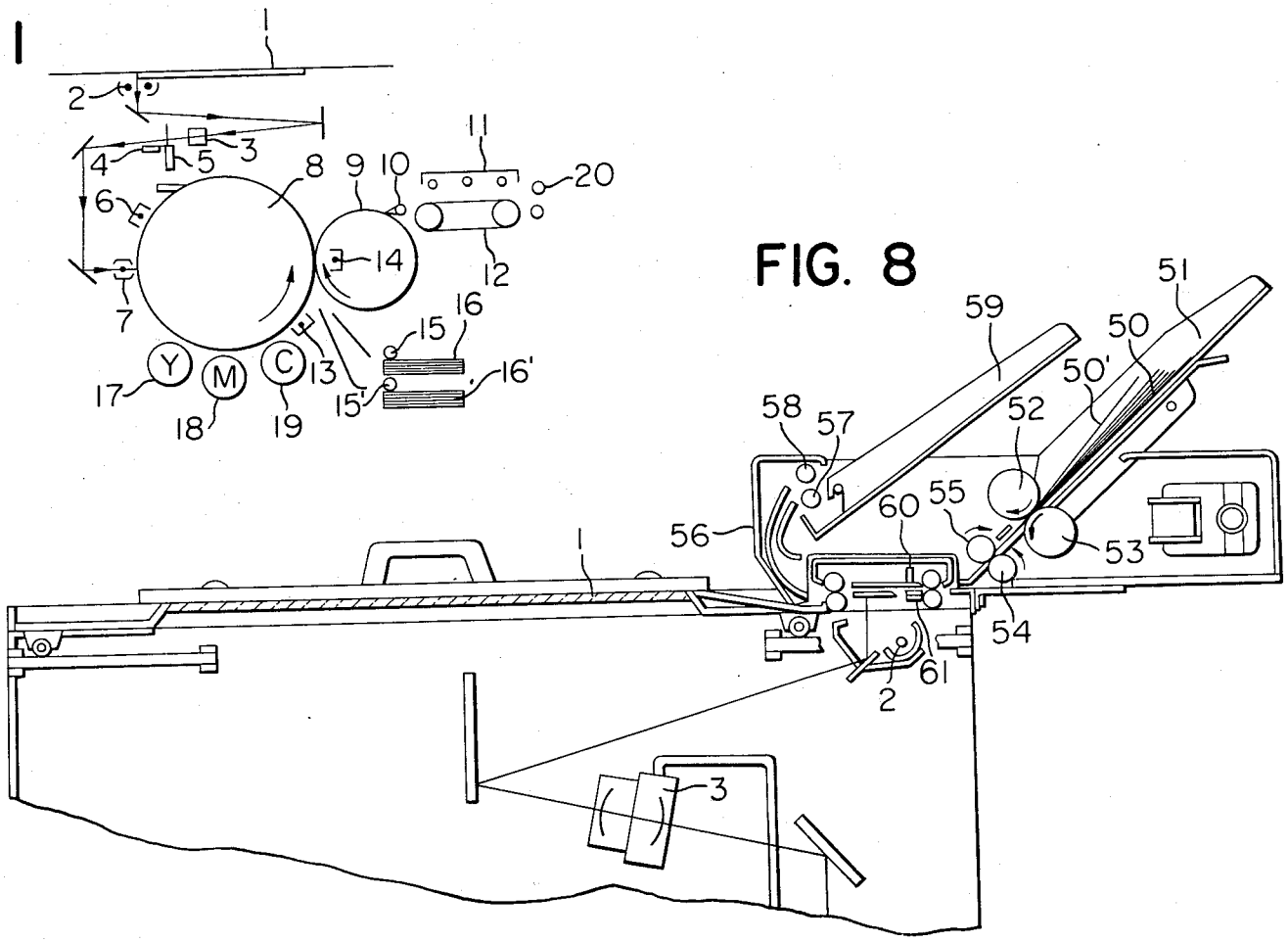
FIG. 1 is a schematic cross sectional view of a copying machine where the present invention is applicable.
FIG. 8 is a cross sectional view of an original automatic feeder where the present invention is applicable.

Now reference is made to FIG. 1 illustrating an example of the color copying apparatus where the present invention is application, which functions in the following manner. An original is scanned, as the result of displacement of an original table 1, with the light from an exposure lamp, and, in case of a true color reproduction with three color mixing, a light image color separated by means of a blue filter 4 is exposed to a photosensitive element on a photosensitive drum 8 thereby dissipating the electrostatic charge, previously formed by a charger 6, by means of said light image and an eliminator 7 to form an electrostatic latent image on said photosensitive element. Said latent image is rendered visible by a yellow developing device 17, and thus obtained visible image is transferred onto a copy sheet wound on a transfer drum 9. Said copy sheet 9, for example of A4 size, is supplied from a selected cassette 16 through a feed roller 15. Successively said original is again scanned and an electrostatic latent image is formed on said photosensitive element in the same manner but through a green filter 4. The thus obtained latent image is rendered visible by a magenta developing device 18, and the thus obtained visible image is transferred onto said copy sheet and superposed on the yellow image previously transferred. Successively the above procedure is repeated with a red filter 4 and a cyan developing device 19 to obtain a visible cyan image, which is superposed by transfer on the two-color image on said copy sheet to complete a three-color superposed image. Thereafter said copy sheet is separated by the function of a separating claw 10, conveyed by a conveyor 12 and subjected to fusion fixing in a fixing device 11 to obtain a true color reproduction of the original, which is ejected from the copying apparatus by a roller 20.

Figure 2A:
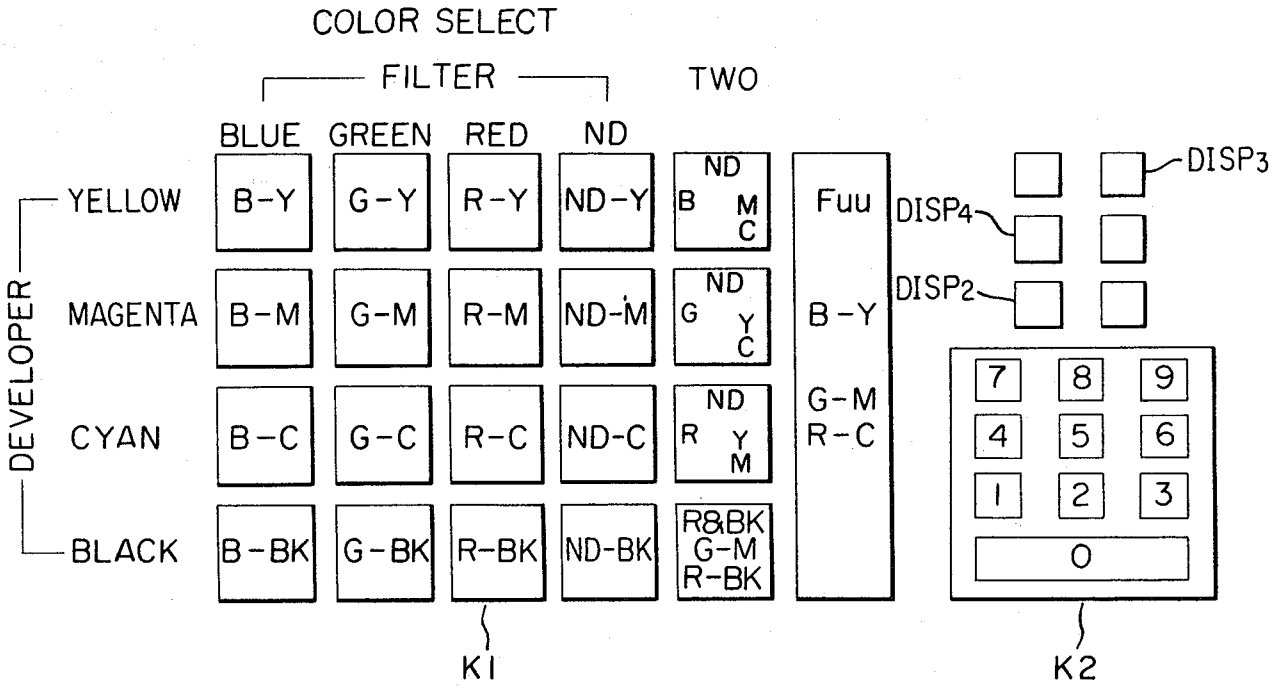

FIGS. 2A and B illustrate an example of a control panel of such a copying apparatus, wherein K1 is a matrix switch allowing selection of arbitrary combination of filter and developing device as further described later and allowing selection and indication simultaneously by means of self-lighting pushbutton switches or of a combination of pushbutton switches and indicating elements such as lamps or light-emitting diodes. Classified indications for two or more conditions are possible by using continuous lighting and intermittent lighting at suitable intervals of the lamp or by using differentiated brightness levels of said indicating element. K2 is a set of ten numeral keys for setting the copy number and copy set number. DISP2, DISP3 and DISP4 are display devices, each of two digits in the illustrated example, respectively for indicating the predetermined copy number, performed copy number in the copying operation currently under execution and predetermined copy number for the succeeding copying operation. Each element of said display device can be composed for example of a 7-segment light-emitting diode. K5 is a group of switches determining the size of the copy sheet and enabling the selection of one of the cassettes each accommodating copy sheets of for example A3, A4, B4 and B5 size, wherein each switch can be provided with an inscription of one of said sizes. Similar to the switches K1, said switches K2 can be of the self-lighting type or can be associated with lamps or light-emitting diodes to indicate the selected size.

K6 (ENT) is a switch for entering the data selected by the switches K1, K2, K5, K7 and K9 into a memory circuit.

K7 (SET) is a switch for determining the copy set number (number of repetitions) wherein said number is designated by the switches K2.

DISP8 is a display device composed of 7-segment light-emitting diodes in a similar manner as in the DISP2 to DISP4, and is divided into an upper display portion for indicating the predetermined copy set number and a lower display portion for indicating the already completed copy set number.

K9 (CHANGE) is a switch for instructing the change of original when such change is necessary, and an indication by lighting is performed by a suitable means as explained in the foregoing at the time of said instruction and also at te time when the original is to be changed. The function of the copying apparatus is temporarily suspended by the CHANGE signal and restarted by the COPY START switch K12. Further, in case an automatic original feeding means such as an automatic feeder (FIGS. 8 and 9) or a step feeder is employed in combination with the copying apparatus, an automatic change of original can be initiated by said signal in a manner as will be described hereinafter.

K10 (PAUSE) is a switch for temporarily suspending the function of the copying apparatus, and K11 (CLEAR) is a switch for cancelling the instructions determined by aforementioned switches K1, K2, K5, K7 and K9. K12 (COPY) is a copy start switch of which actuation, after the various instructions designated by aforementioned switches are entered into the memory circuit by said ENT switch K6, causes the readout of instructions from said memory circuit in the determined order to initiate the copying operation. Also this switch is used for restarting the function of the copying apparatus temporarily suspended by the CHANGE switch K9 or the PAUSE switch K10.

As in the conventional color copier the copying with one copying mode can be achieved by actuating the copy start switch K12 after necessary instructions are determined by the switches K1, K2 and K5, and a single copying can be achieved by actuating a SINGLE switch K13.

K14 (BOTH) is a switch for both-side copying applicable to a copying apparatus provided with a second copy-sheet feeding means, and causes the feeding of copy sheets already having a copied image on one surface thereof from said second feeding means for forming an image on the other surface in a manner as will be described later.

In a copying operation, it is generally necessary to instruct the selection of necessary colors, the necessary copy number and the size of the copy sheet. The present invention is featured by memorizing plural sets of such instructions in advance in a memory circuit and reading the thus memorized instructions in succession to perform the copying operations.

Now referring to FIGS. 3A–D illustrating an example of a control circuit, K1 are COLOR SELECT keys consisting of 21 keys as shown in FIG. 2, among which up to three keys can be arbitrarily selected, though an additional color selection is not allowed for a particular copying operation if two-color copying (TWO) or three-color copying (FULL) is selected for said copying operation.

Figure 7A:
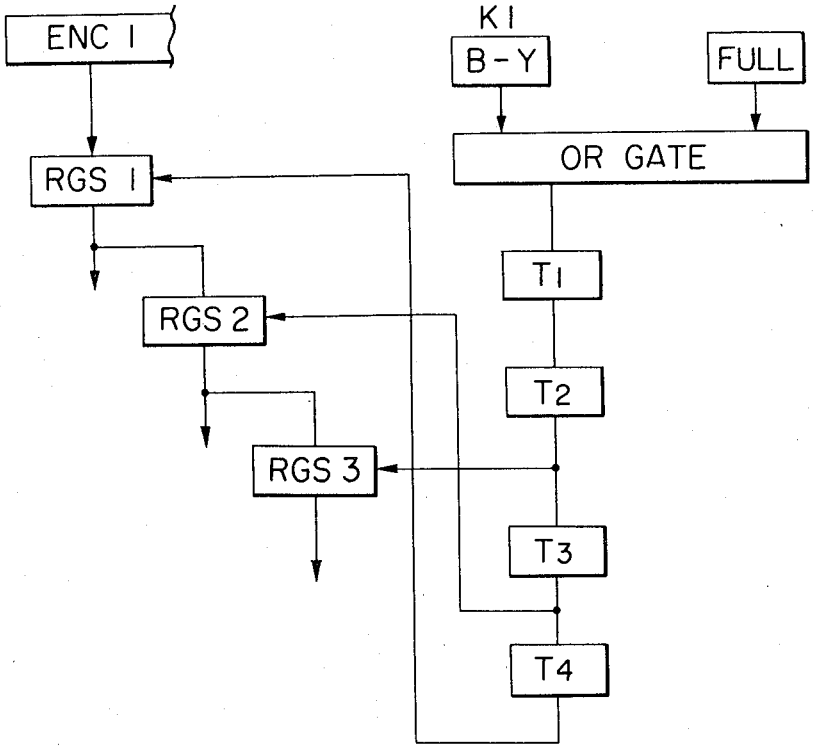
Figure 7B:
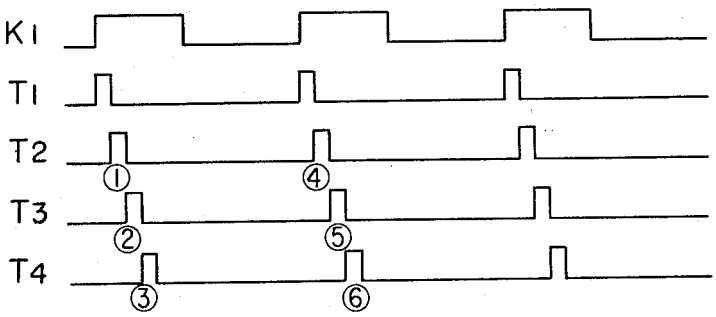

In case a color selection instruction B-Y is selected by a key K1, said instruction is coded by an encoder ENC1 and entered into a register RGS1 in a form of a 5-bit binary signal. Upon selection of an instruction for the second color (for example G-Y), the code corresponding to said second color is entered into said register RGS1 after the code for B-Y contained therein is transferred to a second register RGS2. Further upon selection of an instruction for the third color (for example R-MO, the code (01010) corresponding thereto is entered into the register RGS1 after the contents of registers RGS1 and RGS2 are respectively transferred to registers RGS2 and RGS3. In this manner the color selection signals for the third, second and first colors are temporarily stored respectively in the registers RGS1, RGS2 and RGS3. The data storage procedure into the registers RGS1, RGS2, RGS3 is already known and will therefore be briefly explained with reference to FIGS. 7A and 7B. T1 to T4 shown in FIG. 7A are timers which are activated by the actuation of either one of keys K1 to respectively generate output signals t1 to t4 represented in FIG. 7B. Therefore the first key input is stored into the RGS1 at the signal (3) and transferred to the RGS12 at the signal (5) while the second key input is stored in the RGS1 at the signal (6), and this procedure is repeated in the similar manner.

Supposing that the code signals are increased by =1 in the order or developing devices, the color codes stored in the registers in the above-mentioned manner are 00001, 00101 and 01010.

Successively the content of the RGS1 is supplied to a display device DISP1 through a multiplexer MPX13, a decoder DEC3, a gate GATE1 and a driver DRV3 while the contents of RGS2 and GRS3 are also supplied thereto in a similar manner through MPX14, GATE1, DRV3 and MPX15, DEC5, GATE1 and DRV3, respectively, thereby lighting the indicators (color keys) corresponding to the selected colors. Also in cast a TWO color mode, namely B, G, R or R & BK or a FULL color mode (10101) is selected, a further input into the RGS1 is forbidden upon detection of an output signal from either of 17th to 21st terminal of DEC3 corresponding to a TWO or FULL color instruction. The decoder DEC3, DEC4 or DEC5 is a converter for converting a 5-bit code into a 21-line output, and said driver DRV is an amplifier.

The copy number key switches K2 designate a number which is encoded by an encoder ENC2 into a 4-bit binary code and entered into a register RGS4, of which output is supplied through MPX8, DEC1 and DRV1 to a display device DISP2 to cause a numeral display at right. In case the copy number requires a 2-digit decimal number, the second actuation of a numeral key constituting the lower digit of said number causes the transfer of content of RGS4 into an another register RGS5, with the resulting display through MPX9, DEC2 and DRV2, and, upon completion of said transfer, the instruction by said key K2 is entered into the RGS4 through ENC2, with corresponding display on DISP2 through MPX8, DEC1 and DRV1. In this manner the signals of the lower and upper digits are temporarily stored respectively in RGS4 and RGS5. The decoders DEC1 and DEC2 have a function of converting a 4-bit signal into a 7-segment signal.

The instruction selected the copy sheet size key K5 is encoded by an encoder ENC3 into a 4-bit code and entered into a register RGS6, of which content is indicated, through MPX18, DEC13 and DRV9, on a display device DISP5 for example self-lighting buttons constituting the switches K5. In this manner the sheet size selection is temporarily stored in the register RGS6.

K9 is an instruction switch for control signal for changing the original or for causing an automatic original feeding device to feed a new original, and, upon actuation of said switch K9, the signal therefrom is encoded by an encoder ENC4 and stored in a register RGS7.

Also the signal for both-side copying obtained the switch K14 is similarly encoded by ENC4 and stored in RGS7. For example the code for K9 is 01 while that for K14 is 10. The content of RGS7 is indicated, through MPX20, DEC15 and DRV11, on a display device DISP6 for example a lamp in the self-lighting CHANGE key K9 or BOTH key K14. In this manner the CHANGE signal or BOTH signal is temporarily stored in the register RGS7.

Figure 4A:
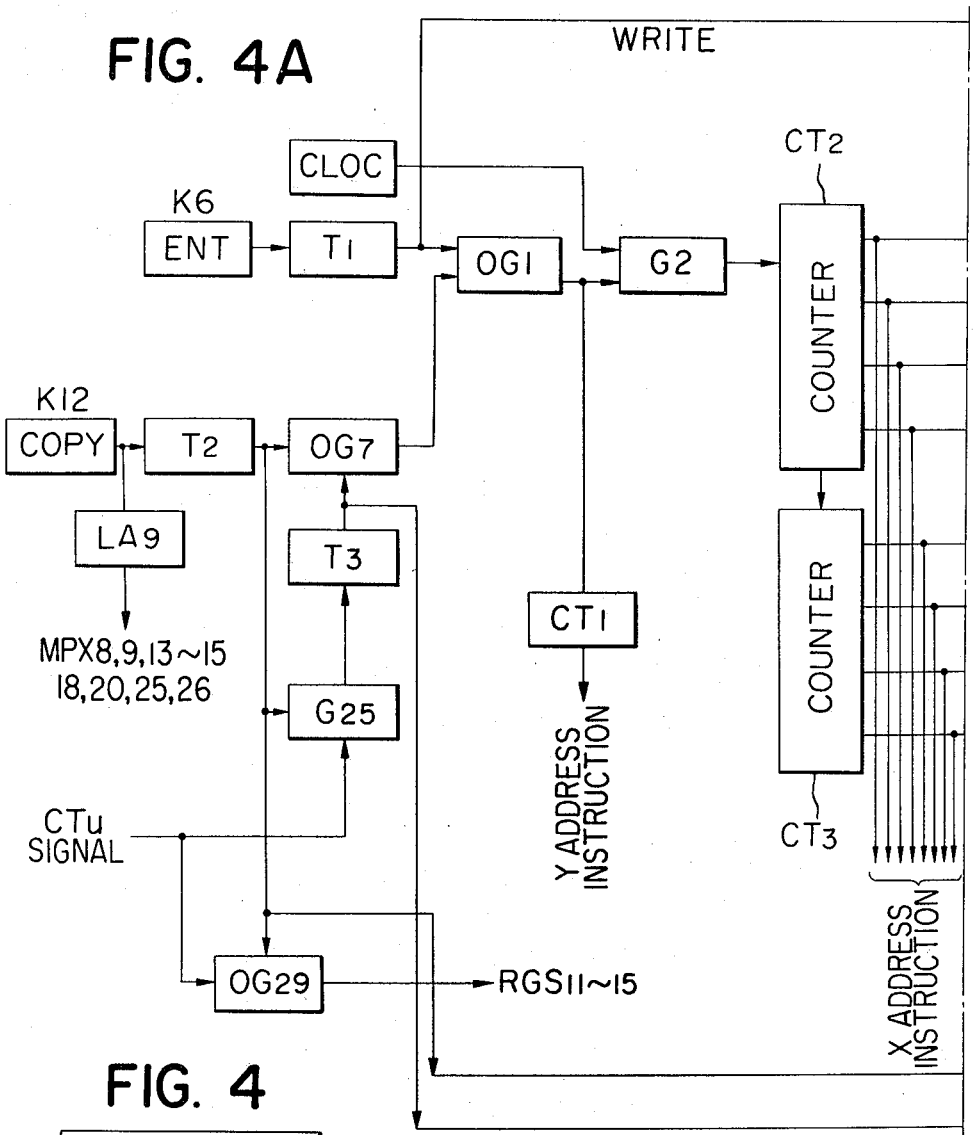
Figure 4:
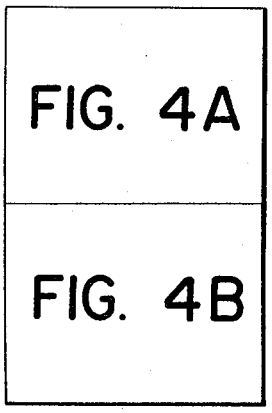
Figure 4B:
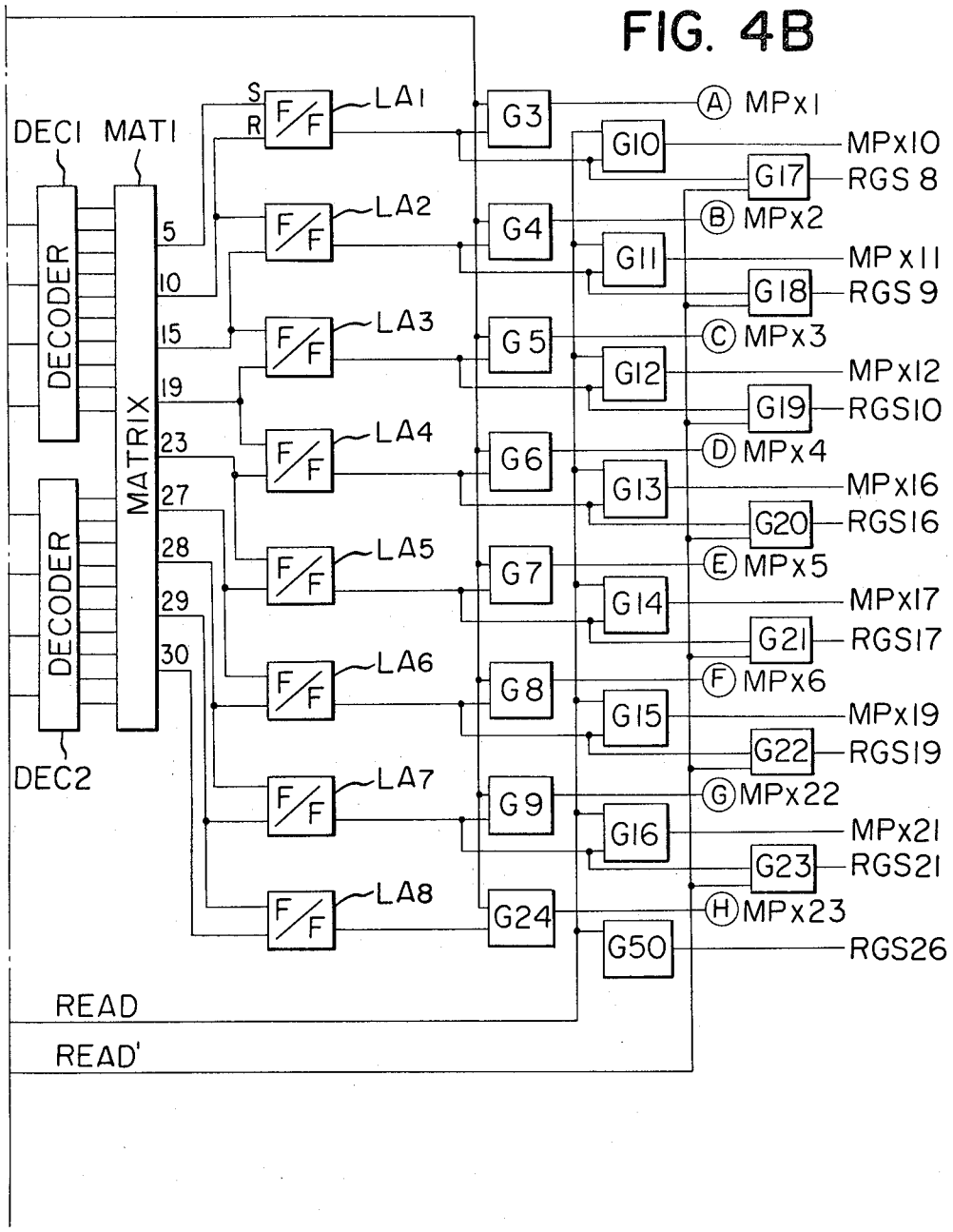

The various copying instructions mentioned above are transferred to a memory RAM by means of the ENT key K6 according to a procedure which will be explained in the following while referring to FIG. 4.

Upon actuation on the ENT key K6, a timer T1 generates a pulse signal of a time suitable for the write-in of data into the memory RAM, while signal, constituting a WRITE signal instructing the write-in into the RAM, is supplied to the gates G3–9, 24 and to the memory RAM. Also said signal, through an 'OR' gate OG1, is supplied together with clock pulses from a clock oscillator to a gate G2, of which output is counted by counters CT2, 3 and converted by a decoder (not represented) into 32-line output utilized for addressing the X addresses 0–31 of the memory RAM. Also the output of said 'OR' gate OG1 is counted by a counter CT1 to designate the Y address of said memory RAM.

Also the output signals of said counter CT2, 3 are decoded by decoders DEC1, DEC2 into decimal signals which are converted by a matrix MAT1 into a trigger signal corresponding to the designated X address, and said trigger signal is supplied to the latches LA1–8. The output pulses of said latches LA1–8, of widths corresponding to the order of memory in the RAM, are supplied to the gates G3–9, 24 to generate actual write-in instruction signals which are supplied to respective multiplexers to cause transfer of the signals temporarily stored in the registers RGS1–7, 23 to the memory RAM and storage therein.

Figure 5:
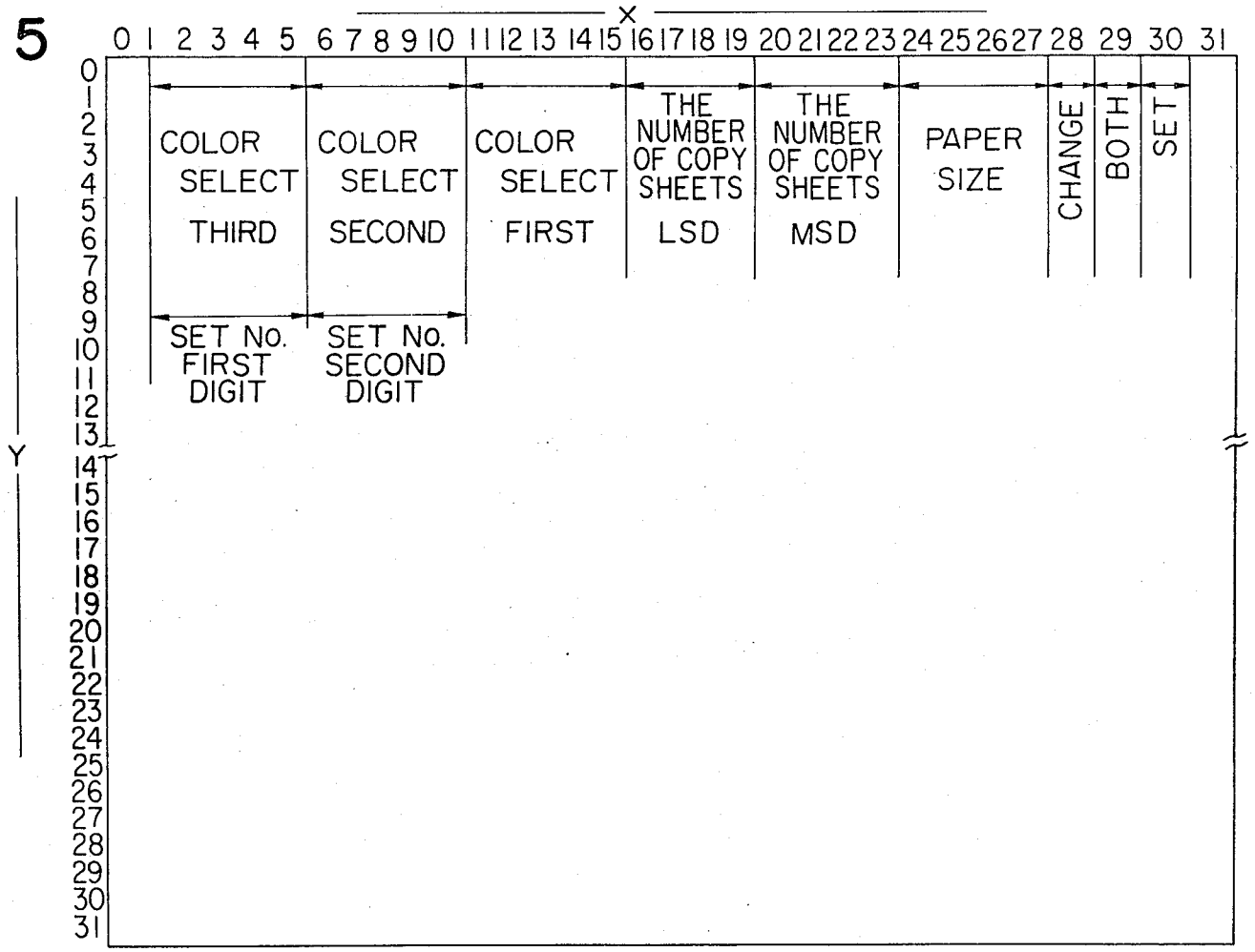
FIG. 5 is an illustration of an example of content of memory according to the present invention.

In the embodiment shown in FIG. 5, the memory RAM memorizes, in each one line thereof, the input data necessary for the operation of one copying mode, corresponding to one ENT signal. The columns X1–X5 accommodate the third color code from the register RGS1, for example 1 for X5 and 0 for the rest in case of B-Y, the columns X6–X10 accommodate the second color code from the register RGS2, for example 1 for X9 and 0 for the rest in case of B-M, the columns X11–X15 accommodate the first color code from the register RGS3, the columns X16–X19 accommodate the code for the lower digit of copy number from the register RGS5, the columns X20–X23 accommodate the code for the upper digit of copy number from the register RGS4, the columns X24–X27 accommodate the size signal from the register RGS6, the columns X28 and X29 accommodate the CHANGE and BOTH signals, and the column X30 accommodates the SET signal from RGS23.

Upon input of the ENT signal, the content of RGS1, being stored in the register RGS22 through a channel MPX1–MPX2–MPX3–MPX4–MPX5–MPX6–MPX-22–MPX23, is memorized in the RAM. Similarly the content of RGS2 is transferred by the output signal (A) of gate G3 through the same channel after the function of MPX1 is switched, the content of RGS3 transferred by the output signal (B) of gate G4 through the same channel starting from MPX2, the content of RGS4 transferred by the output signal (C) of gate G5 through the same channel starting from MPX3, the content of RGS5 transferred by the output signal (D) of gate G6 through the same channel starting from MPX4, the content of RGS6 transferred by the output signal (E) of gate G7 through the same channel starting from MPX5, and the content of RGS7 transferred by the output signal (F) of gate G8 through the same channel starting from MPX6, to the RAM. The register RGS22 is utilized for converting parallel input into serial output thereby supplying parallel data temporarily stored in the registers RGS1–7 to the RAM in the form of time-sequential signal.

After the input of ENT signal, the instructions of the copying mode for the succeeding copying operation are selected by the respective key switches in the above-mentioned manner and are stored in the succeeding line of RAM by the succeeding input of ENT signal.

All the registers, counters, latches, flip-flops and RAM are cleared by turning on the power switch or upon completion of all the copying operations.

Now there will be given an explanation on the read-out function of the memory RAM. Upon actuation of the COPY key to initiate the copying operation, a timer T2 generates a pulse of a width necessary for the read-out of the data of one line in RAM. Said pulse signal is supplied, through gates OG7 and OG1, to a gate G2, which, also receiving the clock signals from a clock oscillator CLOC, releases the clock pulses during a necessary period. Thus released clock pulses are counted by the counter CT2, 3 to designate the X address of RAM. Also the outputs of said counters CT2, 3 are supplied through decoders DEC1, 2 to the matrix MAT1 to activate the latches LA1–8. The output signal from said timer T2, also functioning as the READ signal for reading the content of RAM, to control the multiplexers MPX10, 11, 12, 16, 17, 19 and 21 by means of the output signals of latches LA1–7 and those of gates G10–G16 thereby reading the necessary data from the designated area of memory RAM.

Of the content of one line of RAM, the color instruction in the columns X1–X5 is transferred to RGS11 through MPX10, that in the columns X6–X10 transferred to RGS12 through MPX11, that in the columns X11–X15 to RGS13 through MPX12, the copy number instruction of lower digit in the columns X16–X19 to RGS14 through MPX16, that of upper digit in the columns X20–X23 to RGS15 through MPX17, the size instruction in the columns X24–X27 to RGS18 through MPX19, and the CHANGE and BOTH signal in the columns X28, X29 transferred to RGS20 through MPX21.

Further the contents of RGS11, RGS12 and RGS13 are respectively transferred through MPX13, MPX14 and MPX15 to decoders DEC3, DEC4 and DEC5, of which output signals forwarded to the copying apparatus and simultaneously supplied through GATE1 and DRV3 to DISP1 thereby performing the indication of color selection. As the result there is performed, in the color copier represented in FIG. 1, a selection of a developing device so as to meet the timing of development and selection of a filter so as to meet the exposure timing, in a manner to be explained later.

The contents of RGS14 and RGS15 respectively set the numbers of lower digit and upper digit in the counters CNT1 and CNT2. Said numbers are simultaneously supplied respectively through DEC9, 10 and DRV5, 6 to the display device DISP3 to display said numbers. Also the contents of RGS14 and 15 are displayed through DEC1, 2 and DRV1, 2, with appropriate switching of MPX8 and 9, by the display device DISP2. The display device DISP3 returns to zero upon start of copying, and the counters CNT1, 2 count the paper feed signals from the copying apparatus. The counted number is displayed on DISP3 and simultaneously compared with the predetermined copy number by comparators COMP1 and 2, which, upon coincidence of said two numbers, generate a CTU signal for initiating the copying operation of succeeding copying mode in a manner to be explained later.

At the same time said CTU signal clears the counters CNT1, 2 and terminates the paper feed operation.

The copy sheet size instruction in RGS18 is displayed by DISP5 through MPX18, DEC13 and DRV9. Simultaneously the output signal of DEC13 is supplied to the copying apparatus to perform selection of a cassette accommodating copy sheets and is also utilized for selecting the control system in case difference sequence controls are used for original scanning of different sizes.

The content, CHANGE or BOTH, for RGS20 is supplied to the copying apparatus through MPX20 and DEC15. These signals are, as explained before, for suspending the function of copying apparatus for a while for changing the original or for conducting the both-side copying, and the output of decoder DEC15 is indicated through DRV11 by the display device DISP6.

Upon indication of this signal with interruption of function of the copying apparatus, the user changes the original and actuates the COPY key again to continue the copying operation.

The present invention is further featured by, in addition to the display of mode of copying currently under execution, the display of mode of copying operation to be succeedingly executed. This function will be explained in the following.

The output signal of timer T2 started by the COPY signal and the CTU signal obtained from gate G3 of copy number counters CNT1, 2 are supplied to a gate 25 to start a timer T3 which generates an output pulse of a width identical to that of output pulse from the timer T2. Said signal, together with the output of the timer T2, is supplied to the gate OG7 of which output signal is counted in a manner as explained above, and decoded to drive the latches LA1–8 through matrix. The output signals of said latches LA1–7 are supplied, through the gates G10–16, to the gates G17–23.

Said signal causes the read-out of the content of RAM since the other input terminals of said gates G17–G23 receive a second read-out signal 'READ' supplied from the timer T3 after the first actuation of COPY key or after aforementioned CTU signal.

The data obtained from the RAM in this manner are instructions for the succeeding copying operation since the content of Y-address counter corresponds to a line next to the line memorizing the copying mode currently under execution.

The readout of the instructions of the succeeding copying operation is achieved by a procedure as explained in the foregoing, starting from the transfer of the code from the columns X1–X5 in the line Y2 to the register RGS8 by the control signal from the gate G17 and ending by the transfer of the code in the column X28 to the RGS21 by the control signal from the gate G23.

The contents of registers RGS8, RGS9 and RGS10 are supplied, respectively through decoders DEC6, DEC7, DEC8 and further through the gate G2, the DRV4 which, receiving an intermittent output of a suitable frequency from a signal oscillator, causes the DISP1 to display the copying mode of the succeeding copying operation by intermittently flashing light. It is also possible to provide a separate display device driven by said DRV4.

Also the contents of RGS16 an RGS17 are supplied, respectively through DEC11, DRV7 and DEC12, DRV8, to the display device DISP4 to display the copy member to be achieved in the succeeding copying operation.

Further the content of RGS19 is supplied, through DEC14 and DRV10, to the display DISP5 to display the copy sheet size of the succeeding copying operation by means of intermittent signal as explained above.

Further the content RGS21 is supplied, through DEC16 and DRV12, to the display device DISP6 to indicate the presence, or not, of pause for manual original change or automatic original change by the automatic original feeder or both-side copying in the succeeding copying operation, by means of intermittent signal as explained above.

Upon release of a CTU signal, i.e. upon completion of the current copying cycle, the contents of the registers RGS8, RGS9, RGS10, RGS16, RGS17, RGS19, and RGS21 indicating the copying mode of succeeding copying cycle are transferred respectively through the multiplexers MPX10, MPX11, MPX12, MPX16, MPX17, MPX19, and MPX21, to the registers RGS11, RGS12, RGS13, RGS14, RGS15, RGS18, and RGS20 to initiate a new copying cycle in succession.

Figures 6A, 6B:
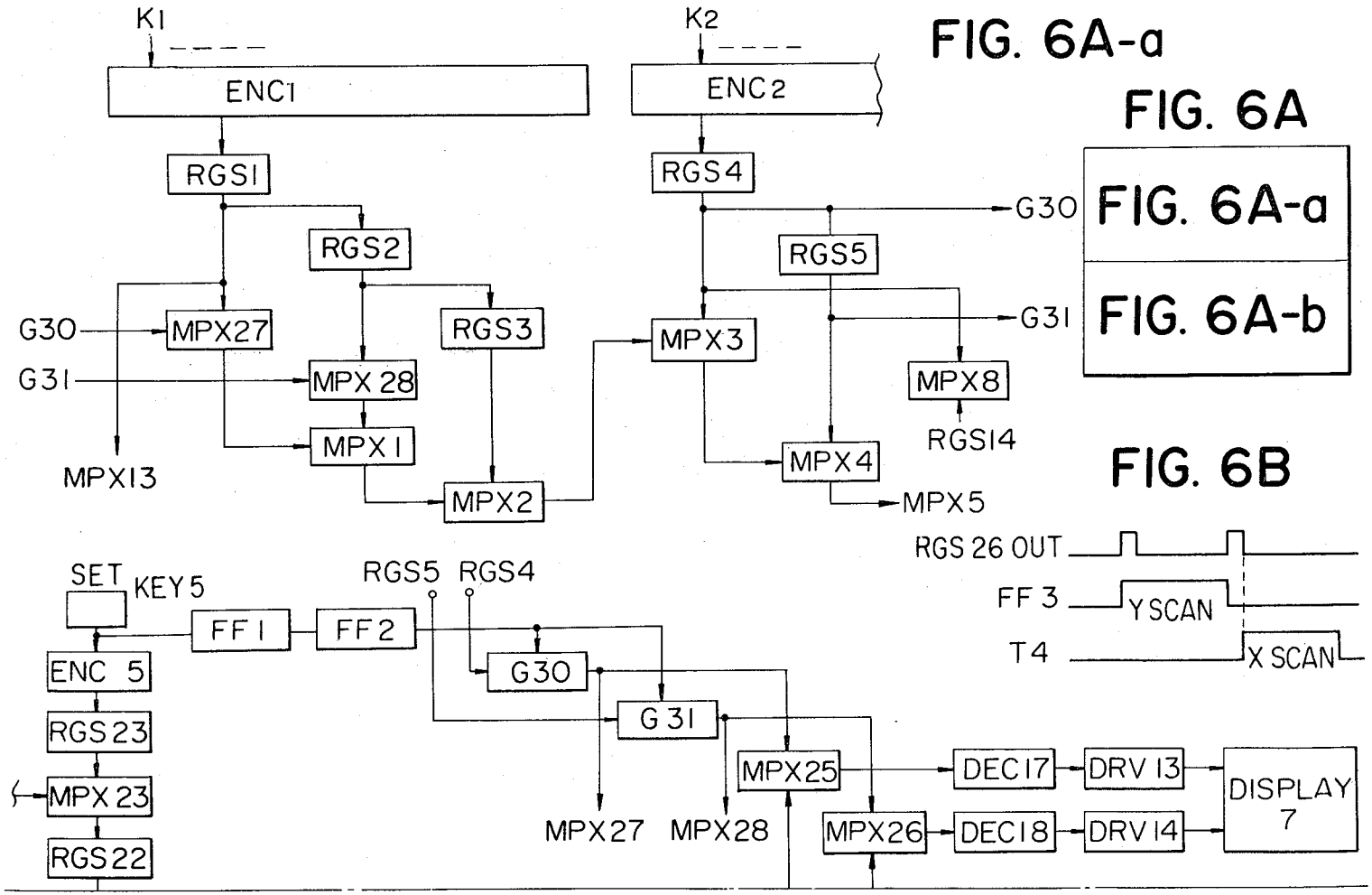
FIGS. 6B and 7B are time charts for explaining the function of the control circuits illustrated in FIGS. 6A-*a* and -*b* and 7A.

Upon completion of said transfer, the further succeeding content of RAM are extracted to the registers RGS8, RGS9, RGS10, RGS16, RGS17, RGS19, and RGS21 and displayed as the copy mode for the further succeeding copying cycle. Now there will be given an explanation on the SET instruction while referring to FIG. 6A representing a circuit which is related to the SET instruction and which is to be connected to the circuit shown in FIG. 3. The SET instruction is utilized for repeating plural times the combination of the above-mentioned various copy modes in a simple operation, and is effective for producing copies of different copying mode from originals changed in succession.

For example, in case of repeating 10 times a 2-mode operation in which a copy of A3 size is produced from an original A with the combinations of greenfilter G and magenta developer M and of red filter R and black developer BK, and then a copy of same A3 size is produced from an another original B with the combination of neutral filter ND and yellow developer Y thereby to produce 20 copies in total, the operator actuate at first the SET key, then enters the data regarding the original A into the memory by the ENT key, then enters the data regarding the original B into the memory b the ENT key, and finally enters the set number "10" into the memory by the numeral keys K2, SET key K7 and ENT key K6. In doing so the copying mode signals such as for color, size, original change etc. are stored in the respective registers in the above-mentioned manner while the SET signal entered by the SET key is encoded by ENC5 and stored in the register RGS23. Upon actuation of the ENT key said mode signals are stored in the determined addresses of RAM while the SET signal in the RGS23 is stored in the address 30 of RAM through a multiplexer MPX23 of which output is switched upon counting 30 clock pulses.

After the copying mode signals regarding the original B are stored by the ENT key into the 2nd line of RAM, the set number is entered, by the copy number numeral keys K2, into the registers RGS4, 5. Upon second actuation of the SET key the SET signal is stored in the RGS23, and successive actuation of the ENT key causes said set number and SET signal to be stored in the 3rd line of RAM. More detailedly, as the second actuation of the SET key is confirmed by the 'set' state of a flip-flop FF2, the contents of RGS4 and RGS5 are supplied, respectively through the gates G30 and G31, to the multiplexers MPX27 and MPX28 of which output signal is switched by the 'AND' output of the output of said FF2 and the gate signals (A), (B) of FIG. 3. Therefore, in combination with the switching of MPX1, the set number is stored in the columns 1–5, and 6–10 of 3rd line in the RAM upon actuation of ENT key after second SET key operation. In this manner the path for the color instruction is utilized also for the set number instruction. Said flip-flop FF2 is cleared by the key input of any of the keys K1. Said set number signal is supplied through MPX25 and MPX26 to the decoders DEC17, DEC18 where it is decoded to 7-segment which are displayed, through drivers DRV13, 14, on the display device DISP7. The Y-address at the write-in procedure is determined by the counter CT1 which is step advanced by the ENT signal.

The readout of said SET signal is achieved in the following manner. In case a SET signal is found in the address X30 upon counting 30 clock pulses from the start of timer, said SET signal is stored in the register RGS26.

In the following an explanation is given on the procedure of performing the copying operations of determined set number from the Y-address line of said SET signal to the Y-address line of succeeding SET signal.

Receipt of the first SET signal in the register RGS26 causes the shifting of FF3 to 'set' state, clearing of RGS26 and storage of Y-address at this moment, which is obtained from the counter CT1, into the RGS27 through the gate G34 with the setting of said Y-address in CNT5. Simultaneously the output signal of FF3 is supplied to the gate G38 to interrupt the step advancement of X-address, and the Y-address of succeeding SET signal is searched. This is achieved by step advancing the CNT5 by the clock pulses and thus step advancing the Y-address alone through G36 until the second SET signal is obtained in the register RGS26, and the Y-address at this moment is stored in the counter CT1 through MPX50 and MPX51. The receipt of second SET signal in the register RGS26 causes the resetting of flip-flop FF3 and opening of the gate G35, this time through an inverter I1, thereby storing the Y-address at this moment in the register RGS28 and setting thereof in CNT6. Successively the set number is obtained by X-address scanning by the clock pulses of one line (timer T4) obtained from the gate G37. In this manner the second SET signal causes the figures in the columns X1–X4 and X5–X8 to be stored in the registers RGS24 and RGS25 respectively representing the lower and upper digits.

Upon completion of the scanning of the period determined by the timer T4, the time-up signal therefrom causes the setting of content of RGS27 in the counter CNT5 and the setting of a number equal to said content plus one in the counter CT1 as the Y-address through multiplexers MPX50, 51.

The set number stored in the registers RGS24, 25 is displayed through the multiplexers, MPX25, 26 in the upper portion of display device DISP8 and also set in the counters CNT3, 4 which are cleared at the start of copying operation and count the set number performed which is displayed in the lower portion of display device DISP8.

Upon returning of the Y-address to a line next to the line of first SET signal, the waiting starts for the count-up signal CTU to be released by the copying apparatus. The X-address gate G38 is reopened by the second SET signal causing the resetting of flip-flop FF3.

Upon receipt of the CTU signal, there is initiated the X-address scanning by the clock pulses in the above-mentioned manner thereby performing readout of the copy mode information from RAM to respective registers. Said scanning is repeated on a line of a step-increased address upon each receipt of CTU signal, and, upon reaching the line of second SET signal, the multiplexer MPX51 is switched to cause the initial Y-address stored in RGS27 to be set in the counter CT1 through MPX51. Also the content of set number counter CNT3 is step advanced by the signal of comparator COMP7. In this manner the copying operation is repeated by reading the copying modes from the line of first SET signal to the line of second SET signal.

Now, when the counts of the counters CNT3, 4 coincide, both lower and upper digits, with the set number stored in the registers RGS24, 25, the gate G40 releases a signal indicating the completion of copying of predetermined set number, which signal step advances the counter CNT6 to designate a line next to the line memorizing the set number. thereby providing the counter CT1 with a new Y-address. The timer T4 is activated by the second output of RGS26 to conduct X-direction scanning during the period T4 in the line memorizing set number.

The multiplexer MPX51 supplies the content of RGS27 when the Y-address after time T4 becomes equal to the address content of RGS28 or the content of counter CNT5 in other instances. Also the Y-address counter CT1 performs step advancement by the output signal of the gate OG1 from the predetermined value, though the advancement is achieved from 0 after operation the completion of programmed copying cycle.

Although the control lines of registers, multiplexers etc. are omitted for simplicity in the foregoing illustrations, the function of such elements will be understandable from the description and associated drawings. Also a RAM of a capacity of $32\times32$ is employed in the foregoing description, but the use of an increased capacity combined with increased capacity of display will enable not only the combination of colors but also the number of digits of copy number etc.

With respect to registers, the registers RGS1–7 are structured to receive input by the key input signal and to be cleared after the content thereof is transferred to RAM by ENT signal. The RGS1 performs the write-in operation after the content thereof is transferred to RGS2 but the re-write-in is forbidden when TWO or FULL signal is given. The RGS2 and 4 perform the write-in operation after the contents thereof are transferred to RGS3 and RGS5 respectively. The registers RGS8, 9 and 10 respectively perform the write-in of the data in the columns X1–X5, X6–X10 and X11–X15 of RAM, after the contents of said registers are transferred respectively to RGS11, 12 and 13 through MPX10, 11 and 12 by the COPY timer signal T2 and CTU signal. The registers RGS11, 12, 13, 14 and 15 are structured to receive the inputs by the respective input signals thereto.

The registers RGS16 and 17 perform the write-in of the data in the columns X16–X19 and X20–X23 of RAM respectively after the contents in said registers are transferred respectively to the registers RGS14 and 15 through MPX16 and 17 by the COPY timer signal T2 and CTU signal.

The register RGS18 receives the input by the input signal thereto, while RGS19 reads the data in the column X24≧X27 of RAM after the content of said register is transferred to RGS18 through MPX19 by the COPY timer signal T2 and CTU signal. The register RGS20 receives the by the input signal thereto, while RGS21 reads the data of the column X28 of RAM after the content of said register is transferred to RGS20 through MPX21. The register RGS23 receives input by the input signal and is cleared after the content thereof is transferred to RAM by the ENT signal. The registers RGS24 and 25 read the data of RAM by the resetting of flip-flop FF3.

With regards to the multiplexers, MPX1 transfers the content of RGS1 or RGS2 to MPX2 respectively when the control signal (A) is at L-level or H-level. Similarly the MPX2 transfers the content of MPX1 or RGS3 to MPX3 respectively when the control signal (B) is at L-level or H-level. MPX3 transfers the content of MPX2 or RGS4 to MPX4 respectively when the control signal (C) is at L-level or H-level. MPX4 transfers the content of MPX3 or RGS5 to MPX5 respectively when the control signal (D) is at L-level or H-level. MPX5 transfers the content of MPX4 or RGS6 to MPX6 respectively when the control signal (E) is at L-level or H-level. Also MPX6 transfer the content of MPX5 or RGS7 to MPX22 respectively when the control signal (F) is at L-level or H-level.

The MPX8 and 9 provide the contents of RGS14 and 15 respectively to the output during the copying operation and the contents of RGS4 and 5 in other periods.

The MPX10, 11 and 12 transfer the data in the columns X1–X5, X6–X10 and X11–X15 of RAM respectively in the presence of COPY and the contents of RGS8, 9 and 10 in the absence thereof.

MPX13, 14 and 15 transfers the contents of RGS11, 12 and 13 respectively during the copying operation and the contents of RGS1, 2 and 3 during other periods. MPX16 and 17 transfer the data in the columns X16–X19 and X20–X23 of RAM respectively in the presence of COPY signal and the contents RGS16 and 17 in the absence thereof. Similarly MPX18 transfers the content of RGS18 during the copying operation and that of RGS6 in other periods. MPX19 transfers the data in the columns X24–X27 of RAM in the presence of COPY signal and the content of RGS19 in the absence thereof. MPX20 transfers the content of RGS20 during the copying operation and the content of RGS7 in other periods. MPX21 transfers the data in the column X28 of RAM in the presence of COPY signal and the content of RGS21 in the absence thereof.

The MPX23 transfers the content of MPX22 or RGS23 to RGS22 respectively when the control signal (M) is at L-level or H-level. MPX25 transfers the content of RGS24 or G30 to DEC17 respectively during the copying operation or not, and MPX26 transfers the content of RGS25 or G31 respectively during the copying operation or not. The functions of MPX27 and 28 are already explained in the foregoing.

In the following there will be given an explanation on an embodiment with an original feeding device, while referring to FIGS. 8, 9 and 10. In FIG. 8 the original drive rollers 52, 53 are activated by the CHANGE signal to separate an original 50′ from an original stack 50. Upon detection of said original 50′ by an original detector (lamp 60 and photosensitive element 61), said rollers 53, 54 are stopped, and again put in motion by the exposure-scanning start signal (for example a signal indicating that the drum is in correct position) to advance said original and initiate the exposure by the lamp 2.

The exposure is performed either by advancing the original through an exposure surface or by maintaining the original on said surface and reciprocating the lamp 2 and associated optical system to scan the original. In the latter method the original is ejected after the exposure is completed.

Figures 9, 9B:
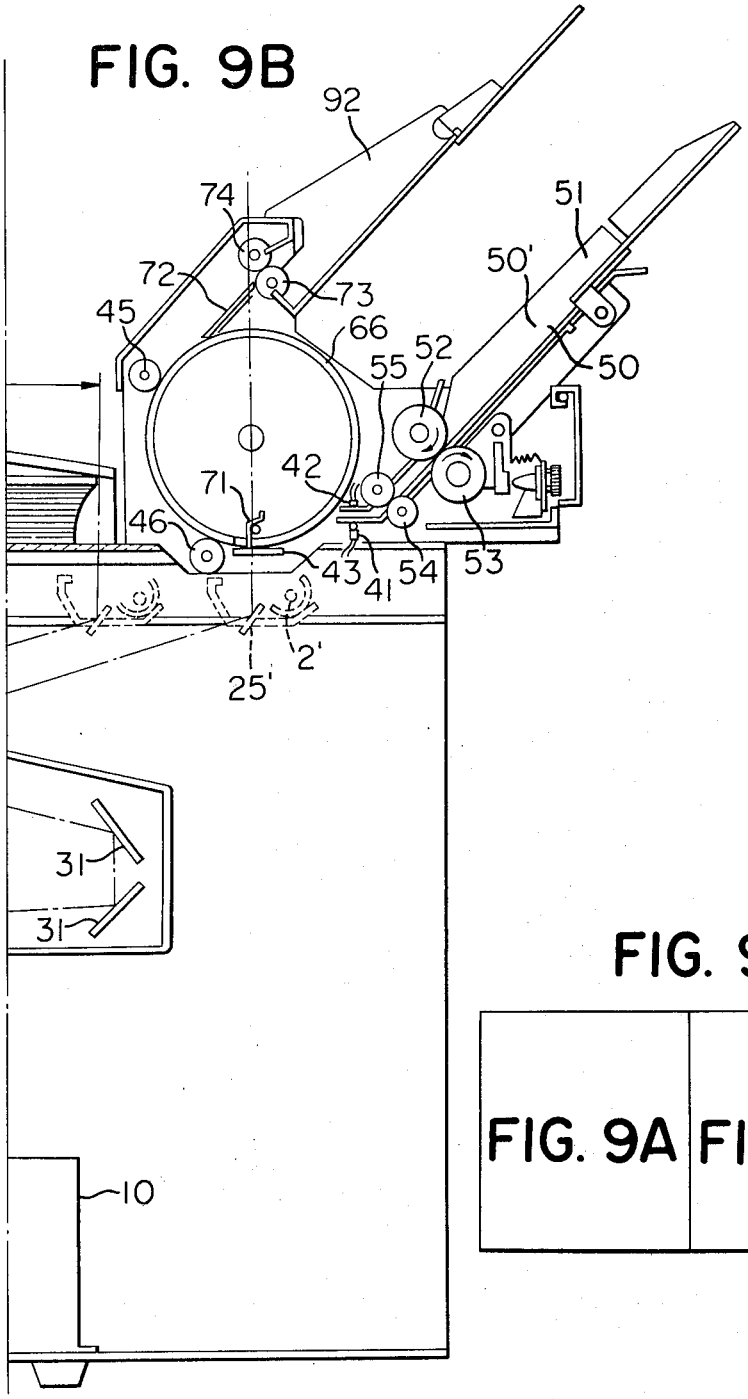
FIG. 9 illustrates the relative position of FIGS. 9A and 9B.
Figure 9A:
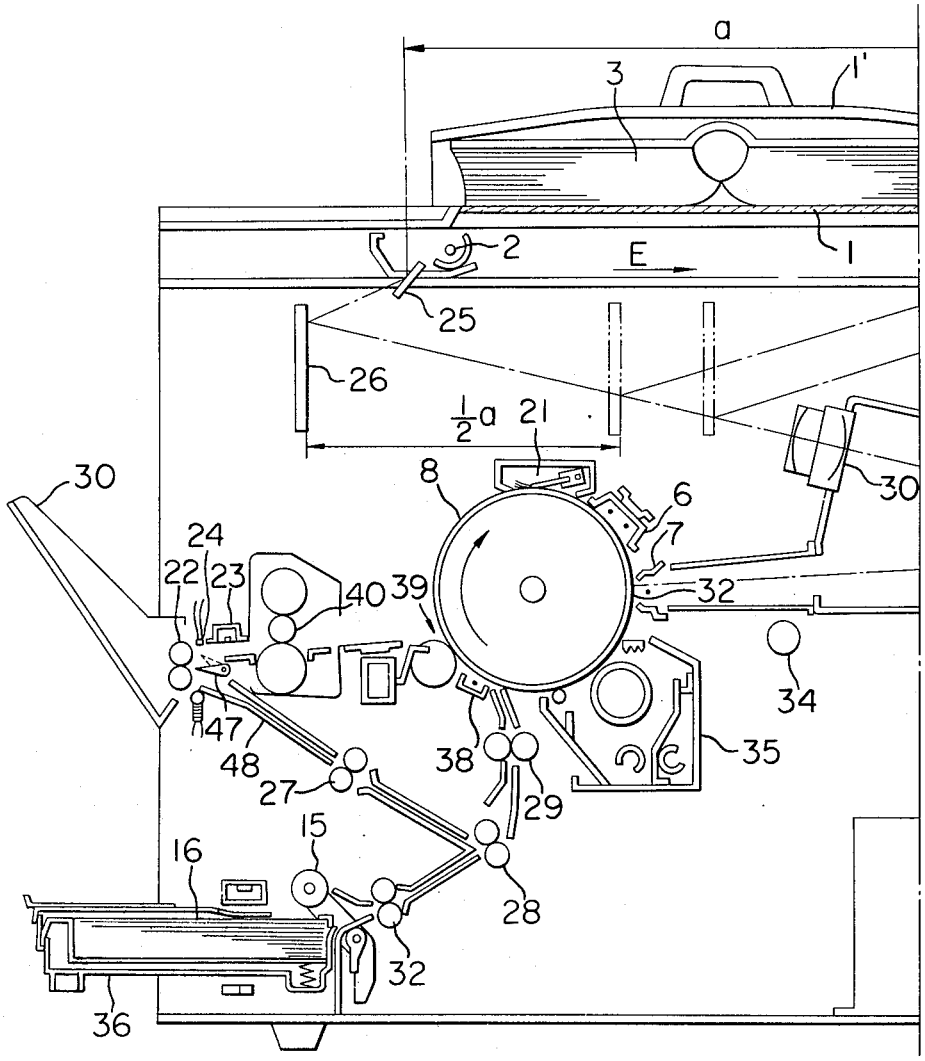
FIGS. 9A and B together provide across sectional view of a two-side automatic feed copying apparatus.
Figure 10A:
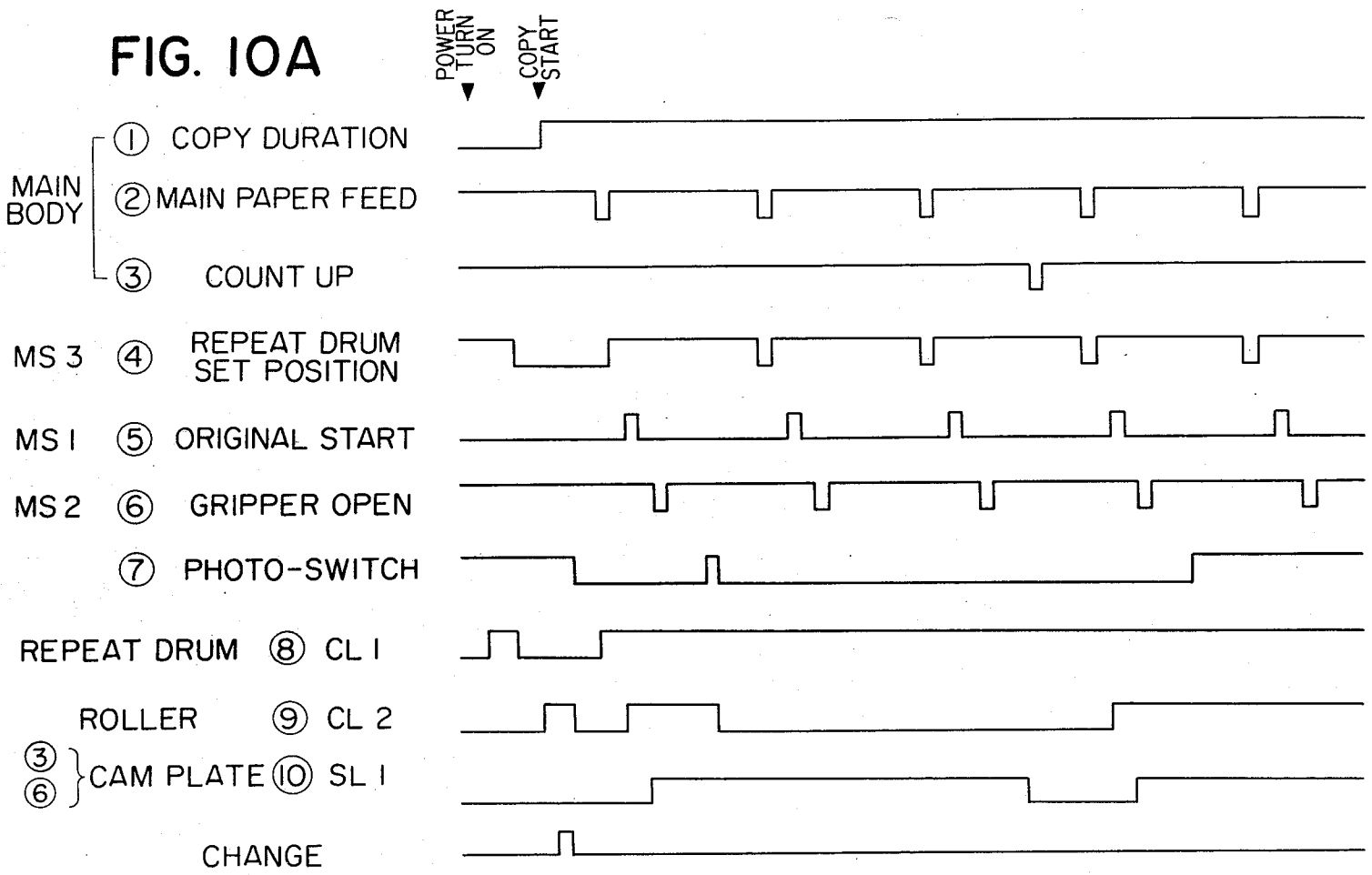
FIGS. 10(A) and (B) are a time chart and an example of automatic feed circuit for use in the apparatus shown in FIG. 9.
Figure 10B:
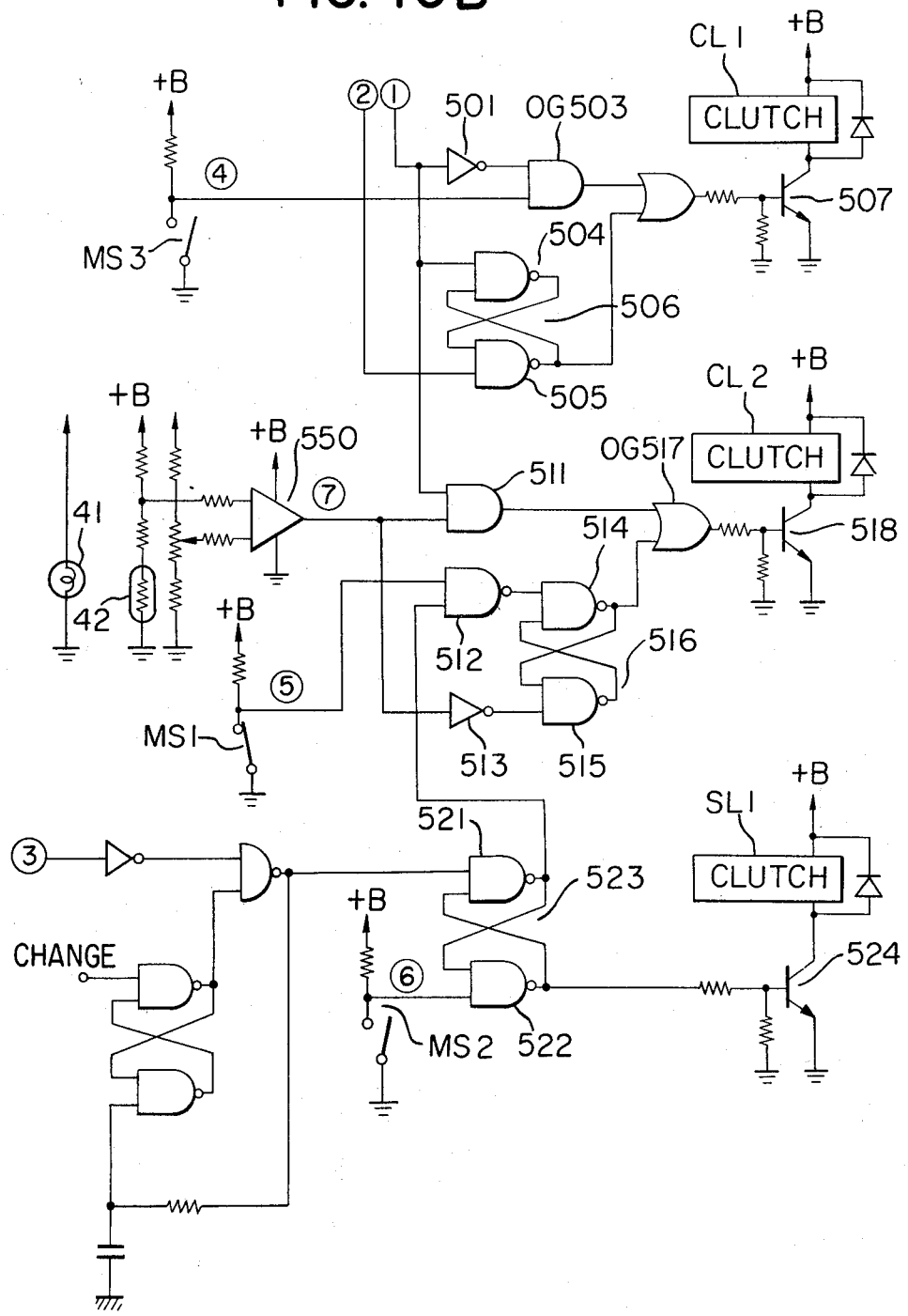

FIGS. 9 and 10 illustrate an embodiment in which a sheet-form original is supported on a repeat drum 66 for repeating the copying operation, wherein the original is supplied and stopped upon detection thereof by a lamp and a photosensitive element 42 in a manner essentially same as mentioned above.

The copy start signal released by the COPY key initiates the rotation of a cam disc in synchronization with the photosensitive drum, and said cam disc generates a paper feed signal which initiates the rotation of said repeat drum 66. Upon rotation thereof to a determined position, said sheet original 50' is again advanced by the rollers 54, 55 and a feed roller 52 to cause the leading end of said original 50' to be clamped by a gripper 71 on said repeat drum 66. In this manner said original is transported over a guide glass 43 and subjected to slit exposure in synchronization with the photosensitive drum 1.

In case of a single copying, said clamping is released upon rotation of the repeat drum 66 to an another determined position, and the leading end of said orginal 50' is pushed toward a guide 72. Thus said original 50' passes between the eject rollers 75, 74 and returned to an original tray 92. After the release of clamping, the original advancement is performed by the press roller 45, 46.

In case plural copying is selected by the key K2, the original after slit exposure passes under said guide 71, with the leading end still clamped by the gripper 71 on the repeat drum 66, to be again subjected to slit exposure on the guide glass 38. After repeating the slit exposure a number of times equal to the required copy number, the original is ejected in the above-mentioned manner. The secod original, upon detection thereof by the lamp 41 and the photosensitive element 42, is maintained standstill and is again made to advance when the first original is released from the gripper 71 and the repeat drum is rotated to the determined position.

The releasing of gripper 71 is achieved by the 'AND' condition of the copy number count-up signal CTU and the CHANGE signal. It is therefore possible to prepare copies of different copying mode such as different copy size again from the same original.

MS1–3 are the detection switches provided on the photosensitive drum for detecting the cam position in order to determine the timing.

FIGS. 10(A) and (B) are the examples of time chart and circuit of automatic feed device shown in FIG. 9. A clutch CL1 is connected to put the repeat drum in rotation upon connection of the power supply, and is disconnected to terminate the rotation when the cam switch MS3 is closed upon arrival of the repeat drum to the home position thereof (in the vicinity of the original clamping position of the gripper 71). Upon actuation of the COPY key, a clutch CL2 is connected to drive the rollers 54, 55 to advance the original. Said clutch is disconnected to terminate the advancement upon detection of the leading end of said original by detectors 41, 42. Successively upon receipt of a paper feed signal from the copying apparatus, a constantly rotating paper feed roller 31 is lowered to advance a copy sheet, and said repeat drum is again put into rotation. A cam disc rotated synchronously therewith closes the switches MS1, MS2 to connect the clutch CL2 again and to energize a solenoid SL1 thereby closing the gripper to clamp the original. The original is exposed to the light of lamp 2' switch on by the COPY key, and the reflected light is directed, through an optical system 30 and mirrors 25', 31, to the photosensitive surface provided with a simultaneous charging device 7. A flip-flop 551 is shifted to 'set' state if a CHANGE signal is obtained in a period t2 determined by the Timer T2 from the start of copying operation (FIG. 4), during which the copy mode is read from the RAM. Successively, upon receipt of a count-up signal CTU (3) from the copying apparatus, a cam plate actuating the gripper is cut off to separate the original from the drum, and a new original is supplied in synchronization with MS1. The flip-flop 551 is reset slightly after the CTU signal, thereby enabling to latch the CHANGE signal which is obtained by the memory scanning during the period determined by the timer T3 after the CTU signal.

On the other hand the electrostatic latent image formed on the photosensitive element 8 is developed in a developing device 35 to form a toner image, which is then transferred by means of a transfer charger 38 onto a copy sheet previously fed, which is then fixed by a fixing roller 40 and a ejected by means of a roller 22 to a tray 30. The drum surface after the image transfer is cleaned by a blade cleaner 21, and, after electrostatic charging by a positive charger 6, is subjected to the imagewise exposure of original in the second rotation of said repeat drum 66 in the above-mentioned manner.

The copying apparatus shown in FIG. 9 is also capable of making copies on both sides of copy sheet by actuating the BOTH key on the control panel. Upon readout of BOTH signal from the RAM, the trailing end of each copy sheet is detected by a paper detector composed of a lamp and a photosensitive element 24. Upon detection at an old number of times a roller 22 is stopped and a claw 47 is elevated to direct the trailing end of copy sheet toward the second feed path 48. Successively said roller 22 is rotated in reverse direction to feed the copy sheet, which has been inserted halfway into the tray 30, into said second feed path 48, and rollers 27 are driven by the paper feed signal PF which is used for driving said paper feed roller 15 thereby advancing said copy sheet to the transfer station. The rotation of said rollers 27 is terminated by the signal from said photosensitive element 24, and the lever 37 is lowered by the signal PF. In this manner said copy sheet receives the transfer of a toner image formed on the photosensitive element at an even number of times, and is ejected to said tray 30. In this copying mode the paper feed roller is actuated only at a PF signal of an odd number of times.

In this both-side copying mode, it is possible, for example, to obtain a single both-side copy from the first and second originals, and 50 sets of two one-side copies from the third original and thereafter, by operating the keys K shown in FIG. 2 in the order of A4, 1, BOTH, CHANGE, ENT, CHANGE, ENT, SET, A4, 2,CHANGE, ENT, SET, 50, and ENT. For the purpose of counting copy number, the paper feed signal is replaced by the signal indicating the actual functioning of roller 15.

The above-mentioned copying apparatus is also adapted for the copying of a bound original, by displacing the lamp 2' and mirror 25' to the positions 2, 25 respectively and performing slit exposure in the E direction. This is achieved by replacing the BOTH key with a BOOK key, also replacing the readout signal BOTH with BOOK and displacing the lamp 2' and mirror 25' to the above-mentioned positions with the lighting of said lamp 2' upon receipt of BOOK signal. For example by key operations in the order of A4, 10, ENT, A4, 2, BOOK and ENT, upon input of copy start signal, there is read a sheet mode signal (signal O) to prepare 10 copies from a sheet original with the lamp and mirror placed at 2' and 25'. Successively, upon receipt of a CTU signal there is performed the readout of following mode signal, and, upon detection of BOOK signal, the function is switched to the book mode to prepare two copies in this mode. The lamp and mirror are returned to the original positions 2', 25' by the succeeding CTU signal, which also clears the register for readout and causes the scanning of 3rd line of RAM. No signals being detected therein, the rotation of drum 8 is terminated after a determined time to complete the copying operation. The power supply is cut off further after a determined period.

Referring to FIG. 10, 550 is a comparator, OG503 and 517 are 'OR' gates, 501 and 513 are inverters while other gates are 'AND' or 'NAND' gates, and 507, 518 and 524 are drivers.

Figure 3:
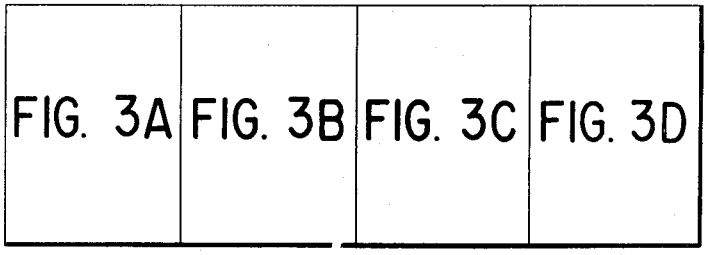
FIGS. 3, 4 and 6A illustrate the relative positions of FIGS. 3A–3D, FIGS. 4A and 4B and FIGS. 6A-*a* and 6A-*b;*
Figure 3C:
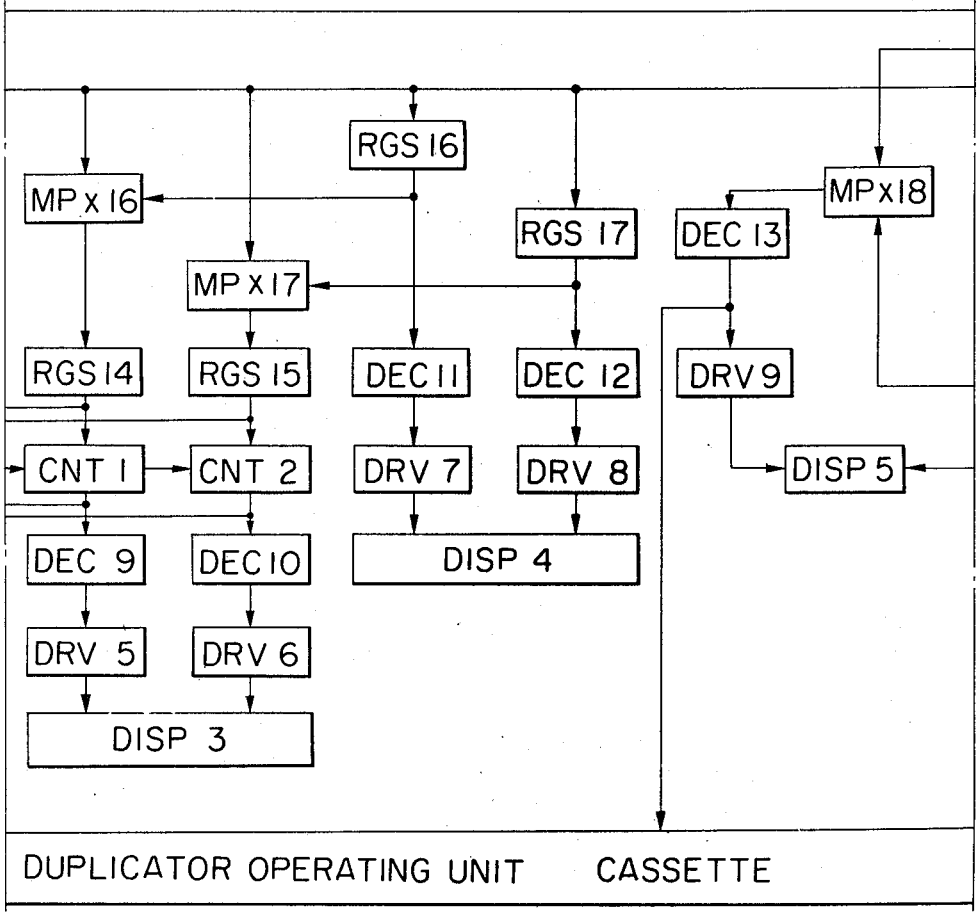
FIGS. 3A–D, 4A and B, 6A-*a* and -*b* and 7A are examples of program control circuits according to the present invention.
Figure 3A:
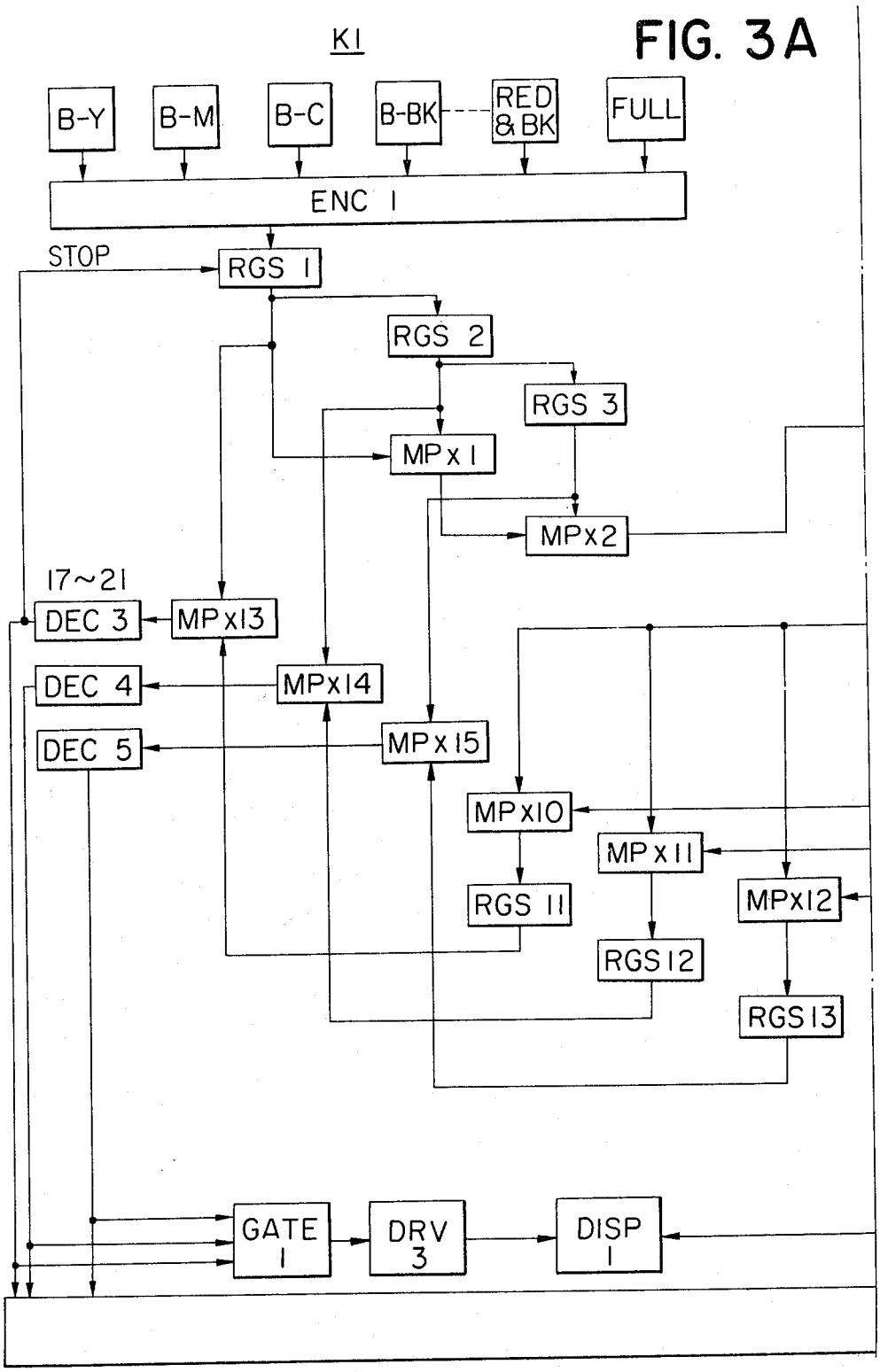
Figure 3B:
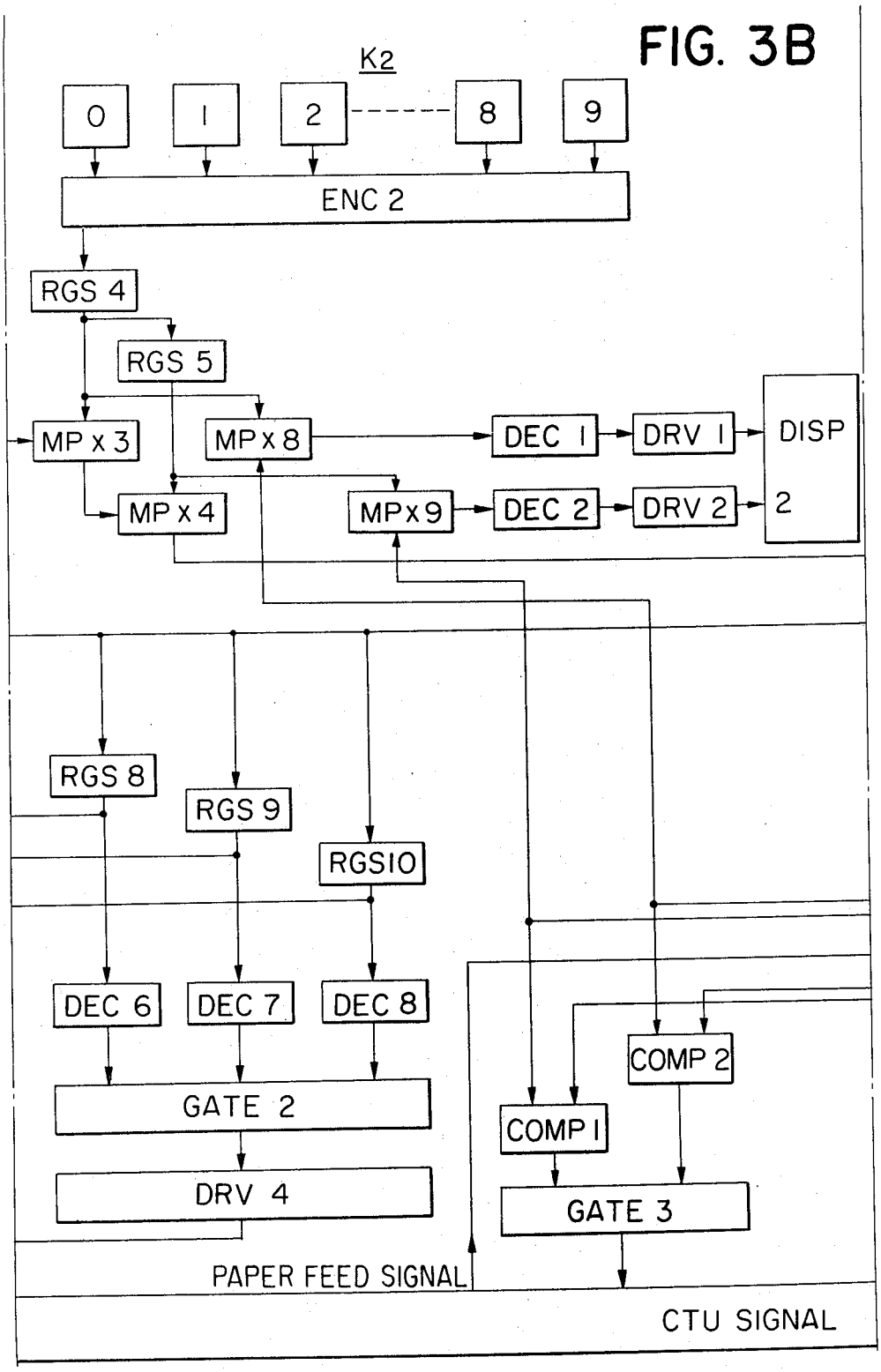
Figure 3D:
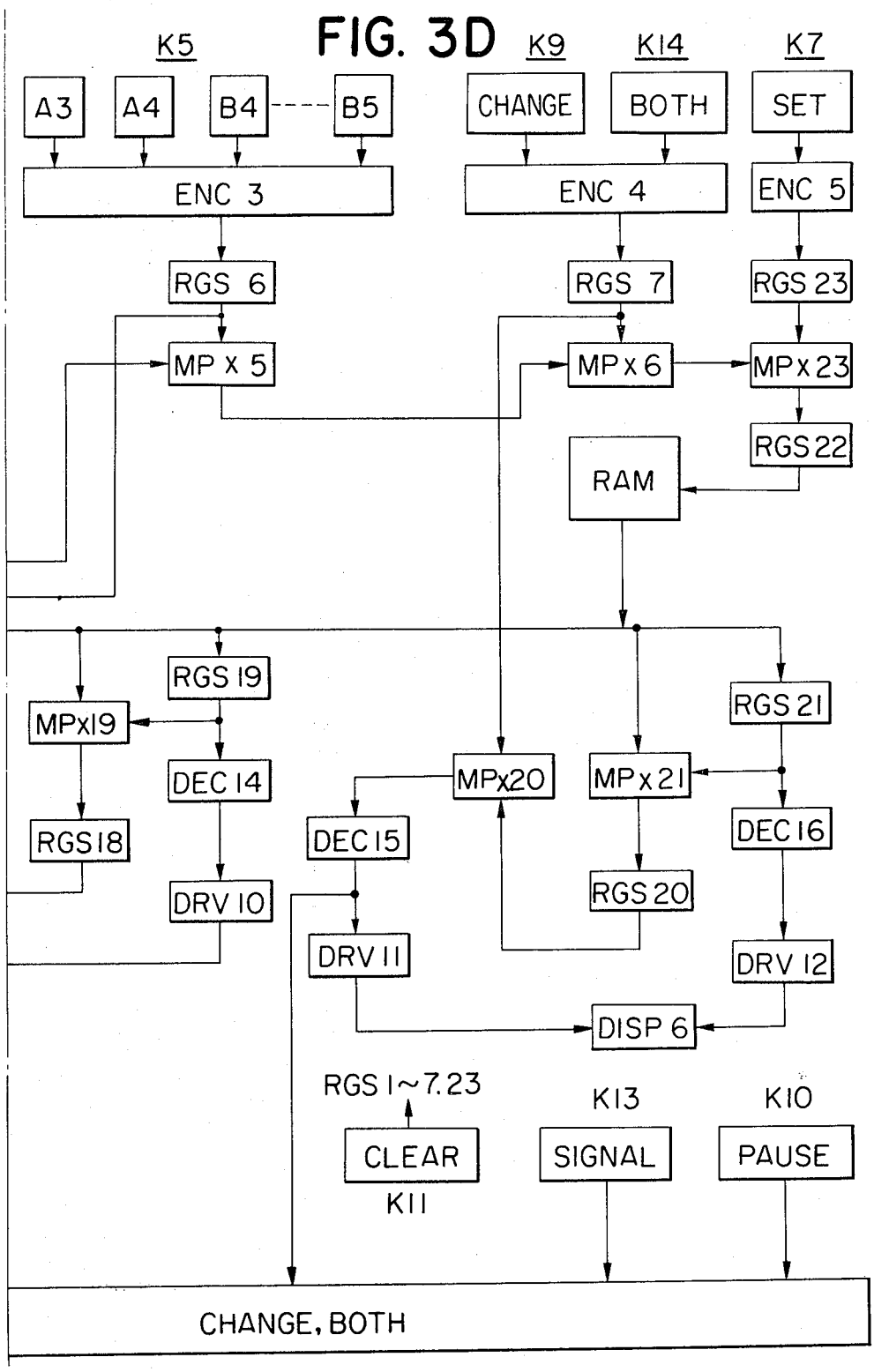
Figure 11:
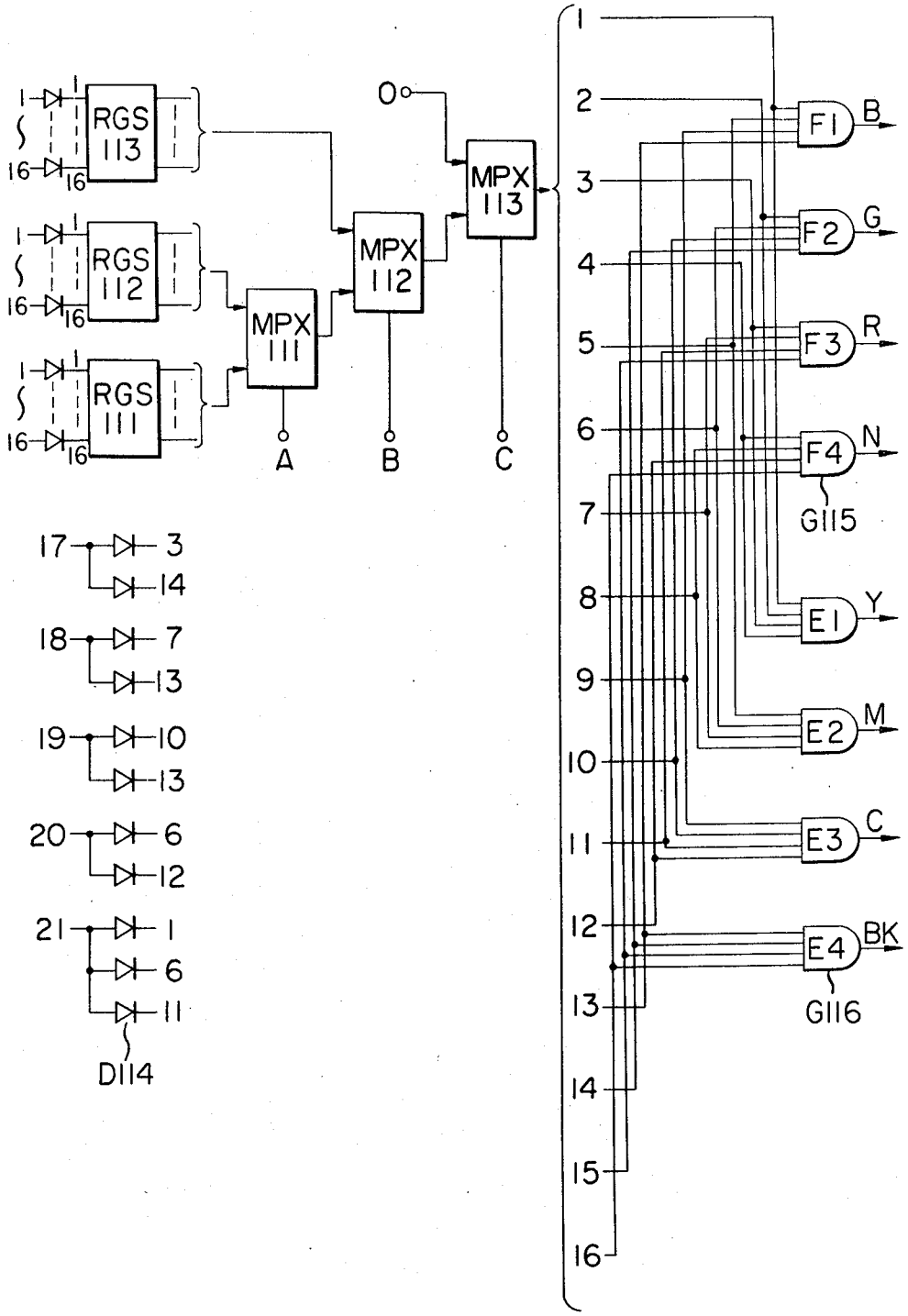
FIG. 11 is an example of color selection circuit.

In the following explained is the color selection. Referring to FIG. 11 illustrating a color selection circuit, the lines 1–6 of 21 lines of decoders DEC3, 4 and 5 shown in FIG. 3 are connected, through diodes D115, respectively to the registers RGS113–111. In this manner the combination of filter and developing device in the 1st, 2nd and 3rd selections are stored, respectively in the RGS111, 112 and 113, the input into which is performed when said decoders give an output. Also the two-color or full-color signal 17–21 is introduced, through diodes D114, to the terminal 1–16 of corresponding registers.

Figure 12:
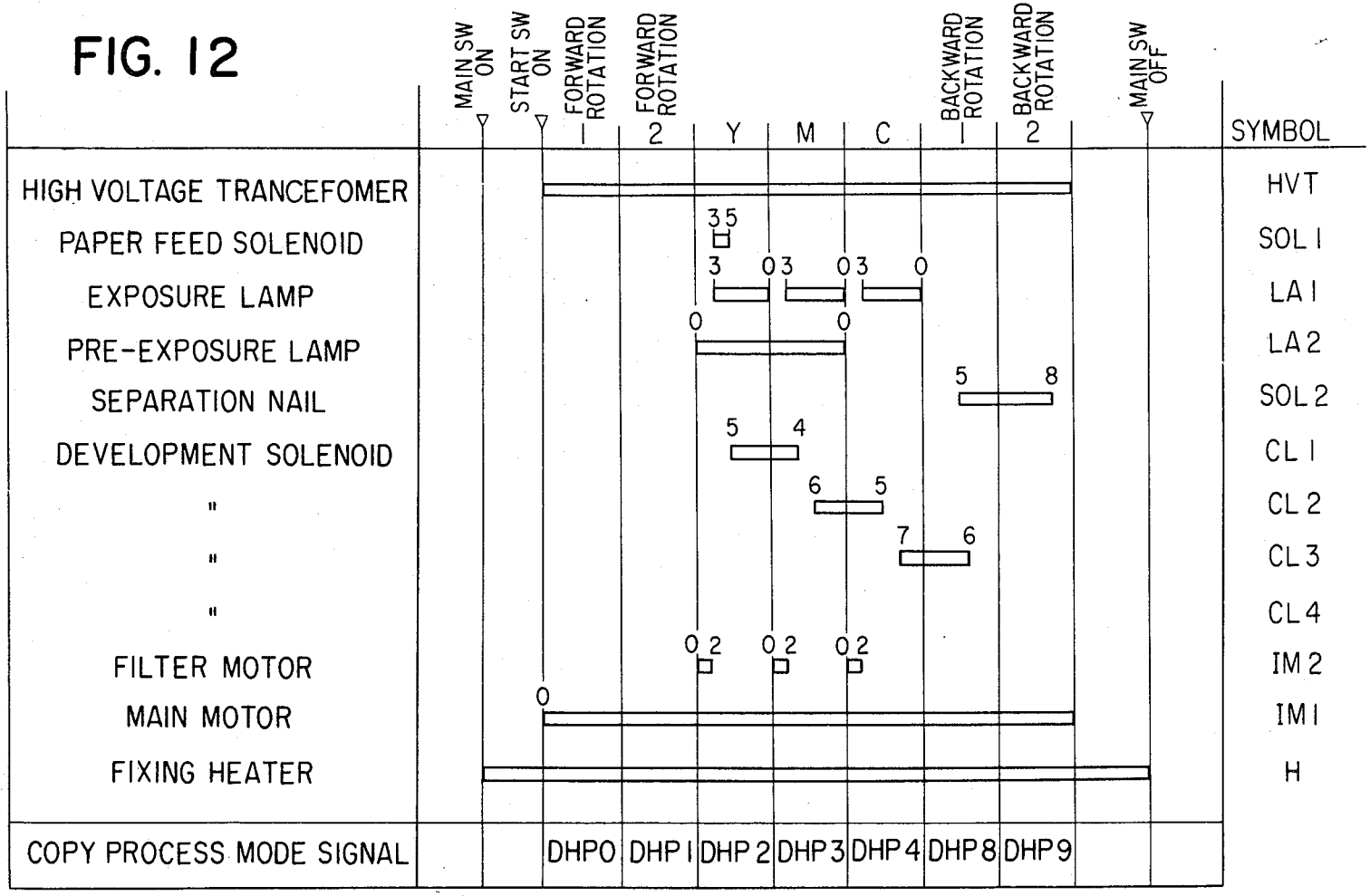
FIG. 12 is a sequence time chart of a color copying apparatus.

The multiplexers MPX111, 112 and 113, upon receipt of L-level signals at A, B and C, causes the MPX113 to release the first color selection in RGS111 thereby designating a filter among B, G, R and N and a developing device among Y, M and C. The receipt of an H-level signal at A and L-level signals at the others causes the release of second color selection while the receipt of an H-level signal at B and a L-level signal at C causes the release of third color selection, and the receipt of an H-level signal at C causes zero output. The signals to the terminals A, B and C are based on the processing mode signal which varies according to the color mode. FIG. 12 shows a time chart, in case of three colors, of the color copier shown in FIG. 1. Upon starting the copying operation, the transfer drum and photosensitive drum perform two rotations and one rotation respectively, and the aforementioned color copying process is conducted by one rotation of transfer drum and by half rotation of photosensitive drum for each color. This is due to a fact that the photosensitive drum is capable of forming two images along the periphery thereof. In case of full color copying the Y, M and C modes are performed in succession, and the drum motor DM1 is switched off to terminate the function of copier after one rotation of photosensitive drum or two rotations of transfer drum. These modes are called $DHO_O$–$9_O$, taking one rotation of transfer drums as the basis. Said photosensitive drum and transfer drum are naturally rotated synchronously by means of said motor DM1. In such operation modes, the function timing of paper feed solenoid SOL1, developing devices or filters is limited to either of said modes. In case of two-color copying the process consists of seven modes: Prerotation 1, 2, color process Y, M, post-rotation 1 and 2, while a single-color copying process consists of three modes: color process Y, post-rotation 1 and 2. In case of multiple copying with full color, the post-rotation modes 1 and 2 are conducted at last after the color process modes Y, M and C are repeated in succession.

Figure 13A:
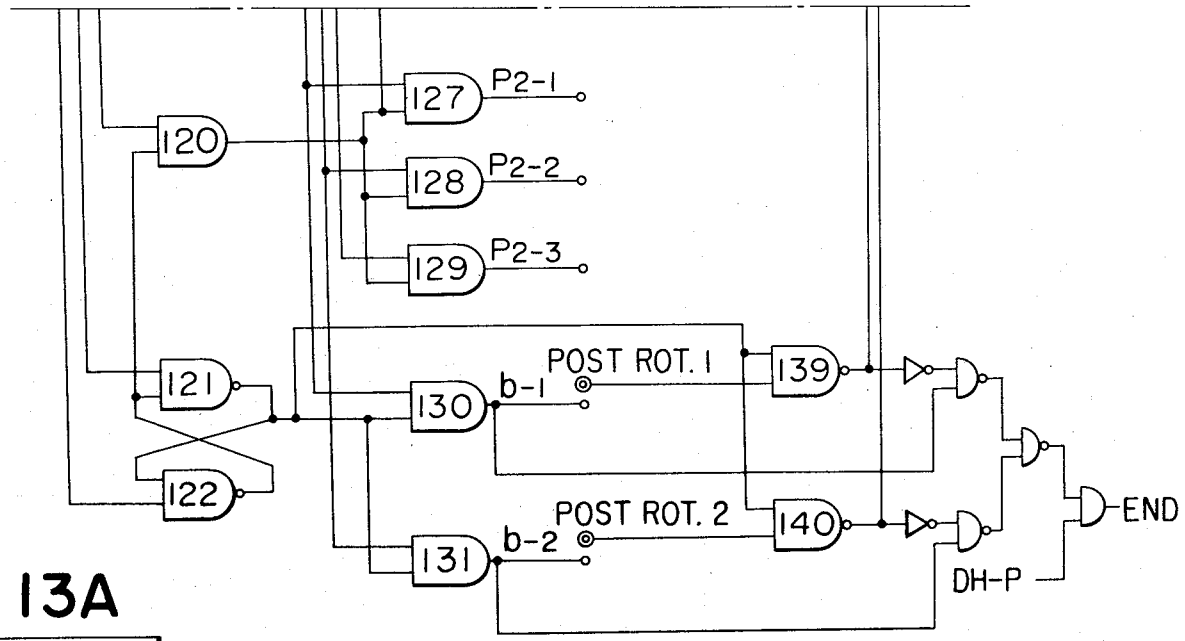
FIG. 13A illustrates the relative positions of FIGS. 13A-*a* and 13A-*b;*
Figure 13B:
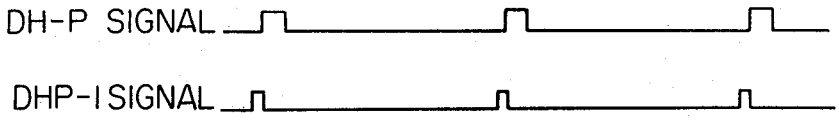

In either of full-color, two-color or mono-color copying, it is therefore necessary to perform the selection of developing devices and filters in suitable process modes. This is achieved by the circuit shown in FIG. 13, wherein the selection of three-color, two-color or one-color is memorized in the gates G134–136, while the numbers of pre- and post-rotations are determined by the gates G101, 132, 133, 139 and 140. The pulses DHP (FIG. 13B) generated by the transfer drum at each passing of home position thereof are counted by flip-flops FF141, 142 to conduct a logic calculation, thereby releasing the process mode signals P1-1–P1-3, P2-1–P2-3 from the gates G124–129, the signals F-1 and F-2 from the gates G104 and G105, and signals b-1 and b-2 from the gates G130 and 131. Also the end of copying operation is identified by a STOP signal from the control panel or a CTU signal, which causes the process to proceed to the post-rotation mode. Also ALL END signal is to switch off the motor DM1 after determined number of post-rotations. The initial resetting is performed by connecting the power supply. The DHP-1 pulse signals (FIG. 13B) are strobe pulses synchronized with the DHP signals and are applied to an input terminal of gate G114.

Figure 15A:
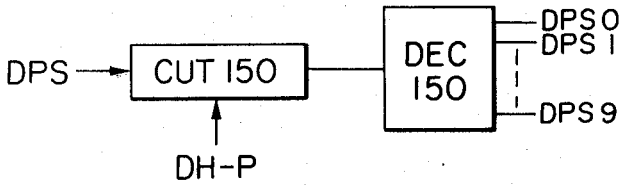
FIGS. 15(*a*) and (*b*) are examples of function timing circuits.
Figure 15B:
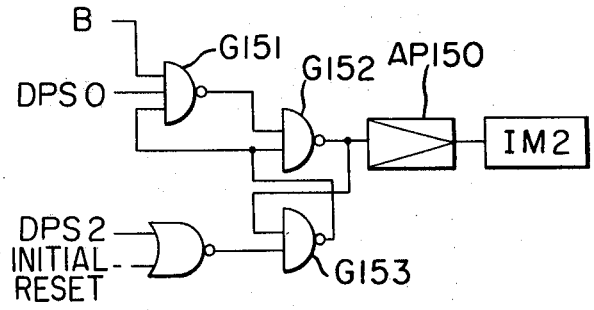
Figure 14:
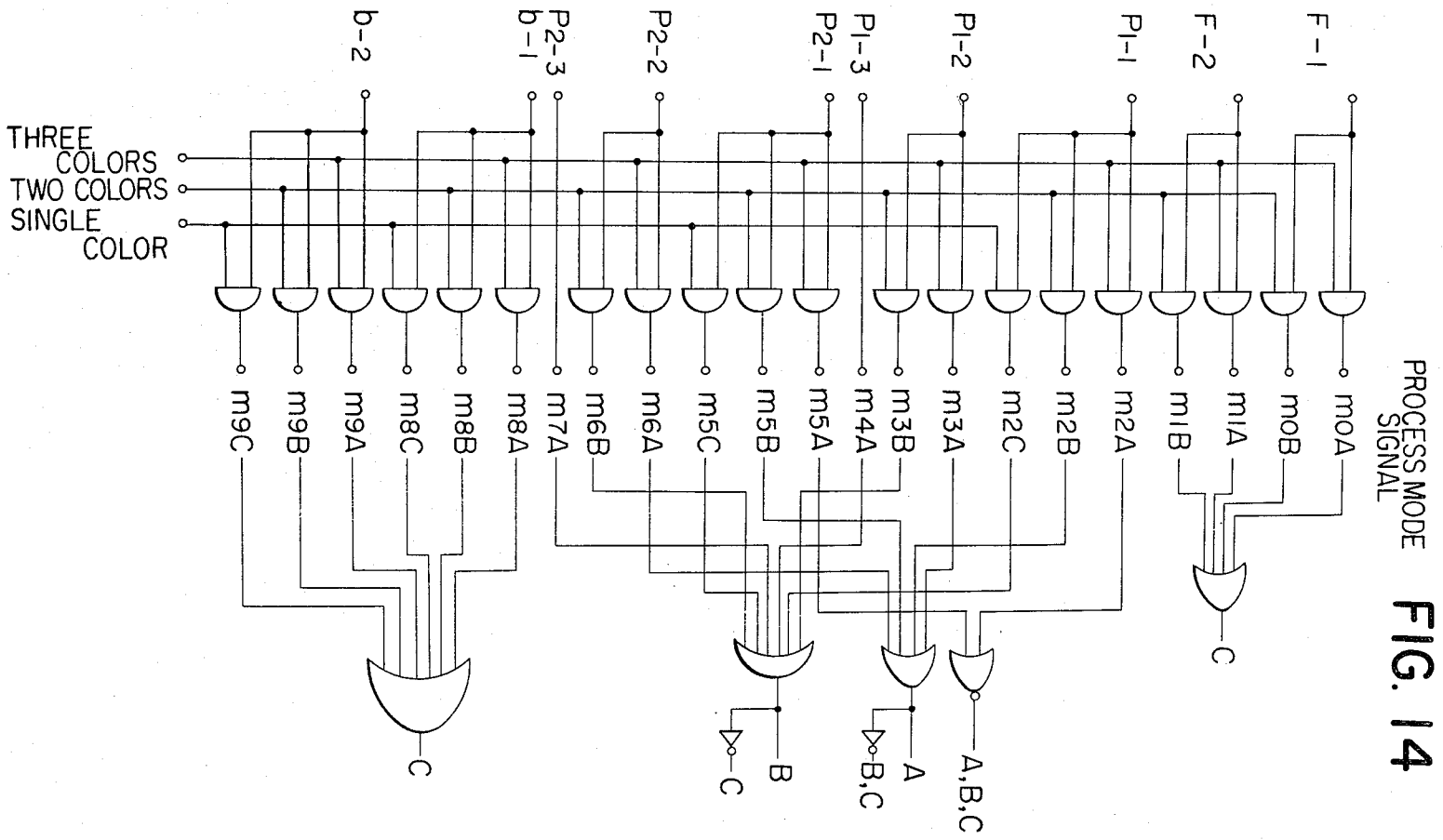

FIG. 14 further illustrates the process modes in case of three-, two- and one-color copying. Upon input of combination of process mode signals to the terminals A, B and C shown in FIG. 11, the set signals of filter and developing device are released at desired mode timings. Also the combination signals of B, G, R, N, Y, M, C and BK are released from the gates (FIG. 15B) by exact timing signals formed by the drum pulse signals DPS. Said timing signals are formed by the counter CNT150 and decoder DEC150, and counted and reset by DHP. For example the blue filter is set at DPSO and reset at DPS2, and between the two it is maintained in the exposure light path by means of an amplifier 150.

Figure 16:
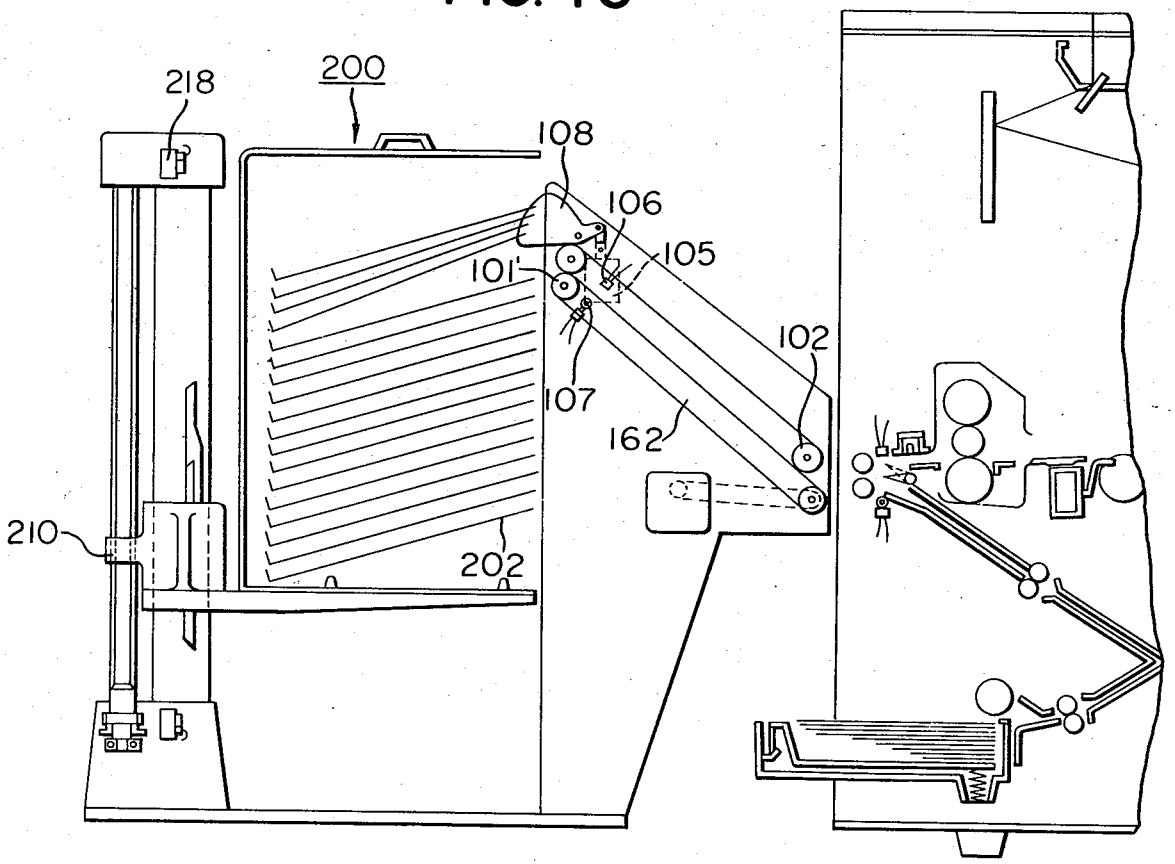
FIG. 16 is a cross sectional view of a sorter.

FIG. 16 illustrates a copier of FIG. 9 provided with a sorter, wherein the present invention is applicable in order to sort the plural copies by means of the SET signal from RAM and said sorter. In FIG. 16, 161 is the sorter, 162 is a copy sheet conveyor belt, 202 is a sorting shelf, and 210 is a sorter elevator. In the beginning the elevator 210 is in an elevated position, and all the shelves 202 are placed on a cam 108. Upon ejection of a copy sheet from the copier and detection thereof by a lamp 106 and a detector 107 after said copy sheet is transported by the belt 162, the elevator is lowered by one step to cause the lowermost shelf to slip off from said cam, thereby causing said copy sheet to be stored on said lowermost shelf. Upon detection of a succeeding copy sheet by 106 and 107, the elevator is further lowered by one step to store said copy sheet in a similar manner. Upon completion of a set of copying, the CTU signal actuate a solenoid 105 to escape the cam 108 and then elevates the elevator 210. The movement of elevator is stopped upon detection of the top position by a switch 218, and the copies of a same number are stored in the same manner. This procedure is repeated until there is reached the set number memorized in the RAM, whereupon all the copying operation is terminated by the signal from gate G40 (FIG. 6(A)). For example 5 sets of 10 copies can be obtained by the key operations in the order of A4, 5, CHANGE, SET, ENT, 10, SET and ENT.

The size instruction signal has a function of selecting one of plural cassettes, which can be achieved by an already known art.

Copying with a modified reduction is also possible by a replacement similar to that in the case of bound original copying. For example this is achieved by providing a reduction key RED, and, upon storage and readout of a reduction signal, by zooming the lens system 30 (FIG. 9) and modifying the scanning speed of exposure.

Further, it will be understood that, in the foregoing embodiments, the readout from the RAM initiated by the copy signal or CTU signal is conducted extremely fast and can be completed before the start of exposure.

As detailedly described in the foregoing, the present invention enables to dispense with the operator for tending the succeeding copying operations, since the copying modes are programmed in advance. For this reason it is advisable to provide a buzzer signal which is to be sounded upon completion of all the copying operations. For example a timer T10 of a time longer than that of timer T2 or T3 (longer than the post-rotation period in case of color copying) is started at each CTU signal, and such buzzer alarm can be started at the expiration of said time.

Also it will be understood that a microcomputer. can be easily employed in the present invention to achieve all the objects thereof with suitable software.

What we claim is:

1. A copying system having a copying apparatus comprising:

storage means for storing different copy mode data for each of a plurality of copying operations, wherein each copying operation comprises the formation of a plurality of complete copies; and control means for causing said copying apparatus to carry out a first copying operation to obtain a first plurality of copies in accordance with first copy mode data stored in said storage means, and, after terminating the first copying operation, to carry out a second copying operation to obtain a second plurality of copies in accordance with second copy mode data stored in said storage means, wherein the second copy mode data is different from the first copy mode data and is stored in said storage means during the first copying operation.

2. A copying system according to claim 1, further comprising manually actuatable input means for entering the copy mode data into said storage means and instruction means for instructing the storage of the copy mode data from said input means in said storage means.

3. A copying system according to claim 2, wherein said instruction means includes key input means for enabling the second copy mode data from said input means to be stored in such storage means without affecting the first copy mode data stored in said storage means.

4. A copying system according to claim 2, wherein said input means includes exchange instruction means for instructing the exchange of an original document to be copied.

5. A copying system according to claim 1, wherein the first and second copy mode data are entered before said copying apparatus initiates the copying operations.

6. A copying system according to claim 1, wherein said system further comprises means for detecting the termination of the copying operation in accordance with the first copy mode data, and the output of said detecting means causes said copying apparatus to then begin the copy operation in accordance with the second copy mode data.

7. A copying system according to claim 1, further comprising means for displaying the copy mode data in connection with the copying operation currently being performed and the copy mode data in connection with the next copying operation.

8. A copying system according to claim 1, further comprising a sorter for sorting the copies according to the copy mode data under the control of said control means.

9. A copying system according to claim 1, wherein said system further comprises original feed means capable of exchanging different original documents, and wherein said exchanging is controlled in accordance with the copy mode data under the control of said control means.

10. A copying system according to claim 1, further comprising means for causing said copying apparatus to carry out the copying operation according to the second copy mode data after terminating the copying operation according to the first copy mode data, and to then again carry out the copying operation according to the first copy mode data.

11. A copying system according to claim 1, wherein said copy mode data corresponds to the reproducing color for the copy sheet to be copied.

12. A copying system having a copying apparatus comprising:

means for setting different reproducing colors;

storage means for storing color data corresponding to the different reproducing colors sequentially set by said color setting means for each of a plurality of copying operations, wherein each copying operation forms at least one complete copy; and control means for causing said copying apparatus to carry out a first copying operation to obtain at least one copy with a reproducing color according to first reproducing color data stored in said storage means, and after terminating the first copy operation, to carry out a second copy operation to obtain at least one copy with a reproducing color according to second reproducing color data stored in said storage means, wherein said second reproducing color data is different from said first reproducing color data and is stored in said storage means during the first copying operation.

13. A copying system according to claim 12, wherein said system further comprises a plurality of color filters for separating the light reflected from an original document being copied into a plurality of color components, and a plurality of color developers, wherein said reproducing color data indicate a combination of said color filters and said color developers.

14. A copying system according to claim 13, wherein said reproducing color setting means selects the combination of said color filters and said color developers.

15. A copying system according to claim 12, wherein said first and second reproducing color data are entered before said copying apparatus initiates the copying operation.

16. A copying system according to claim 12, further comprising means for causing said copying apparatus to carry out the copying operation according to the second reproducing color data after terminating the copying operation according to the first reproducing color data, and to then again carry out the copying operation according to the first reproducing color data.

17. A copying system according to claim 12, further comprising instruction means for instructing the transfer of the reproducing color data set by said setting means to said storage means.

18. A copying system having a copying apparatus comprising:

first switch means for setting copy mode data for a copying operation;

storage means for storing first and second copy mode data for a plurality of copying operations, wherein each copying operation comprises the formation of a plurality of complete copies set by said first switch means;

second switch means for enabling the second copy mode data for a second copy operation to be set in said storage means by said first switch means without affecting the first copy mode data for a first copy operation stored in said storage means; and control means for causing said copy apparatus to carry out the first copy operation to obtain a first plurality of copies and the second copy operation to obtain a second plurality of copies in accordance with the first and second copy mode data stored in said storage means, wherein during the time that the copying operation according to one of the first and second copy mode data is being carried out, the other copy mode data is retained in said storage means.

19. A copying system according to claim 18, wherein said copy mode data corresponds to the reproducing color for the copy sheet to be copied.

20. A copying system according to claim 18, wherein said first and second copy mode data are entered before said copying apparatus initiates the copying operation.

* * * * *

UNITED STATES PATENT OFFICE

CERTIFICATE OF CORRECTION

Patent No. 4,275,958 Dated June 30, 1981

Inventor(s) TACHIKA, TETSUJI ET AL.

It is certified that error appears in the above-identified patent and that said Letters Patent are hereby corrected as shown below:

Column 3, line 54, "te" should be --the--.

Column 4, line 62, "=1" should be --+1--.

Column 5, line 1, "GRS3" should be --RGS3--;

line 5, "cast" should be --case--;

line 60, "while" should be --which--.

Column 11, line 7, "number." should be --number,--;

line 54, "X24≥X27" should be --X24-X27--.

Column 13, line 24, "secod" should be --second--.

Column 14, line 22, "old" should be --odd--.

Signed and Sealed this

Ninth Day of February 1982

[SEAL]

Attest:

GERALD J. MOSSINGHOFF

Attesting Officer

Commissioner of Patents and Trademarks